US010167128B2

(12) United States Patent
Nevo et al.

(10) Patent No.: US 10,167,128 B2
(45) Date of Patent: Jan. 1, 2019

(54) INFLATOR DEVICE AND METHOD FOR INFLATABLE PACKAGING

(71) Applicant: Airguard Ltd., Ein HaMifratz (IL)

(72) Inventors: Shlomo Nevo, Tel-Aviv (IL); Moshe Malik, Kfar-Yona (IL); Asaf Levin, Atlit (IL)

(73) Assignee: Airguard Ltd., Ein HaMifratz (IL)

( * ) Notice: Subject to any disclaimer, the term of this patent is extended or adjusted under 35 U.S.C. 154(b) by 398 days.

(21) Appl. No.: 14/890,624

(22) PCT Filed: May 4, 2014

(86) PCT No.: PCT/IL2014/050403
§ 371 (c)(1),
(2) Date: Nov. 12, 2015

(87) PCT Pub. No.: WO2014/199368
PCT Pub. Date: Dec. 18, 2014

(65) Prior Publication Data

US 2016/0122112 A1 May 5, 2016

Related U.S. Application Data

(60) Provisional application No. 61/833,960, filed on Jun. 12, 2013.

(51) Int. Cl.
*B65D 81/05* (2006.01)
*B31D 5/00* (2017.01)
*B65B 55/20* (2006.01)

(52) U.S. Cl.
CPC ..... *B65D 81/052* (2013.01); *B31D 5/0073* (2013.01); *B65B 55/20* (2013.01)

(58) Field of Classification Search
CPC ..... B31D 5/0073; B65D 81/052; B65D 81/03
See application file for complete search history.

(56) References Cited

U.S. PATENT DOCUMENTS 4,017,351 A 4/1977 Larson et al.
4,240,556 A 12/1980 Field
(Continued)

FOREIGN PATENT DOCUMENTS

CA 2381938 8/2000
CH 703963 4/2012
(Continued)

OTHER PUBLICATIONS

Communication Pursuant to Rule 114(2) EPC dated Mar. 24, 2015 From the European Patent Office Re. Application No. 12856617.1.
(Continued)

*Primary Examiner* — Timothy L Maust
*Assistant Examiner* — Timothy P Kelly

(57) ABSTRACT

An inflation device for pressurized inflation of an un-inflated package, the package comprising two layers, which are generally flat prior to inflation, and an inflation opening, the inflation device comprising an inflation tool, for contacting the package at the inflation opening to inflate the package through the inflation opening using inflation fluid from a pressure source, the inflation tool having an enclosing surface to enclose the inflation opening externally of the package. The inflation tool is larger than the inflation opening so as to ensure that the inflation opening is actually enclosed.

15 Claims, 24 Drawing Sheets

(56) References Cited

U.S. PATENT DOCUMENTS

| | | | |
|---|---|---|---|
| 5,263,587 | A | 11/1993 | Elkin et al. |
| 5,420,556 | A | 5/1995 | Okazaki |
| 5,427,830 | A | 6/1995 | Pharo |
| 5,445,274 | A | 8/1995 | Pharo |
| 5,469,966 | A | 11/1995 | Boyer |
| 5,570,788 | A | 11/1996 | Batsford |
| 5,588,532 | A | 12/1996 | Pharo |
| 5,620,069 | A | 4/1997 | Hurwitz |
| 5,620,096 | A | 4/1997 | Pozzo |
| 5,762,197 | A | 6/1998 | Farison |
| 5,769,231 | A | 6/1998 | Batsford |
| 6,056,119 | A | 5/2000 | Risgalla et al. |
| 6,213,167 | B1 | 4/2001 | Greenland |
| 6,244,440 | B1 | 6/2001 | Tschantz et al. |
| 6,276,532 | B1 | 8/2001 | Sperry et al. |
| 6,283,296 | B1 | 9/2001 | Newman |
| 6,398,029 | B1 | 6/2002 | Farison et al. |
| 6,513,974 | B2 | 2/2003 | Malone et al. |
| 6,520,332 | B1 | 2/2003 | Barmore et al. |
| 6,571,954 | B2 | 6/2003 | Nadler |
| 6,598,373 | B2 | 7/2003 | Sperry et al. |
| 6,629,777 | B2 | 10/2003 | Tanaka et al. |
| 7,168,566 | B2 | 1/2007 | Anderson et al. |
| 7,220,476 | B2 | 5/2007 | Sperry et al. |
| 7,223,461 | B2 | 5/2007 | Kannankeril et al. |
| 7,823,729 | B2 | 11/2010 | Lee |
| 7,874,428 | B2 | 1/2011 | Kojima et al. |
| 9,764,862 | B2 * | 9/2017 | Borgeat ..... B65B 1/04 |
| 2005/0100251 | A1 | 5/2005 | Havens et al. |
| 2006/0218879 | A1 | 10/2006 | Garceau et al. |
| 2007/0295633 | A1 | 12/2007 | Liao et al. |
| 2012/0000807 | A1 | 1/2012 | Scarbrough et al. |
| 2014/0328551 | A1 | 11/2014 | Nevo |

FOREIGN PATENT DOCUMENTS

| | | |
|---|---|---|
| EP | 2632706 | 9/2013 |
| FR | 2456677 | 12/1980 |
| WO | WO 2012/055053 | 5/2012 |
| WO | WO 2013/088372 | 6/2013 |
| WO | WO 2014/199368 | 12/2014 |

OTHER PUBLICATIONS

International Preliminary Report on Patentability dated Dec. 23, 2015 From the International Bureau of WIPO Re. Application No. PCT/IL2014/050403.

International Preliminary Report on Patentability dated Jun. 26, 2014 From the International Bureau of WIPO Re. Application No. PCT/IB2012/057244.

International Search Report and the Written Opinion dated May 7, 2013 From the International Searching Authority Re. Application No. PCT/IB2012/057244.

International Search Report and the Written Opinion dated Aug. 26, 2014 From the International Searching Authority Re. Application No. PCT/IL2014/050403.

Supplementary European Search Report and the European Search Opinion dated Nov. 9, 2015 From the European Patent Office Re. Application No. 12856617.1.

Supplementary Partial European Search Report (Rule 164(1) EPC) dated Jun. 29, 2015 From the European Patent Office Re. Application No. 12856617.1.

Communication Pursuant to Article 94(3) EPC dated Oct. 13, 2016 From the European Patent Office Re. Application No. 12856617.1.

Restriction Official Action dated Nov. 9, 2016 from the US Patent and Trademark Office Re. U.S. Appl. No. 14/364,719. (11 pages).

Official Action dated Feb. 17, 2017 From the US Patent and Trademark Office Re. U.S. Appl. No. 14/364,719. (32 pages).

Communication Pursuant to Article 94(3) EPC dated May 17, 2017 From the European Patent Office Re. U.S. Appl. No. 12856617.1. (6 Pages).

Official Action dated Jun. 21, 2017 From the US Patent and Trademark Office Re. U.S. Appl. No. 14/364,719. (15 pages).

Communication Pursuant to Article 94(3) EPC dated Jul. 18, 2017 From the European Patent Office Re. Application No. 14729057.1. (6 Pages).

Official Action dated Oct. 20, 2017 From the US Patent and Trademark Office Re. U.S. Appl. No. 14/364,719. (16 pages).

Applicant-Initiated Interview Summary dated Dec. 11, 2017 From the US Patent and Trademark Office Re. U.S. Appl. No. 14/364,719. (3 pages).

* cited by examiner

INFLATOR DEVICE AND METHOD FOR INFLATABLE PACKAGING

RELATED APPLICATIONS

This application is a National Phase of PCT Patent Application No. PCT/IL2014/050403 having International filing date of May 4, 2014, which claims the benefit of priority under 35 USC § 119 (e) of U.S. Provisional Patent Application No. 61/833,960 filed on Jun. 12, 2013. The contents of the above applications are all incorporated by reference as if fully set forth herein in their entirety.

FIELD AND BACKGROUND OF THE INVENTION

The present invention, in some embodiments thereof, relates to an inflator device and method for inflatable packaging, and, more particularly, but not exclusively, to a device for inflating packaging to protect products during transportation, particularly but not exclusively, products which require the packaging to pass a drop test to ensure the products are safe from damage.

Commonly used protective packaging includes bubble wrap, rigid blocks of polystyrene foam, and foam beads. All of these take up considerable storage space and transportation volume.

Such products are readily available and highly successful. However they have the disadvantage of being bulky and thus causing handling difficulties, as they are used on a large scale, for example in factories and warehouses, and like places where packaging is carried out on an industrial scale. Specifically, prefabricated polystyrene foam (EPS) packages and polyethylene foam (EPE) planks require storage space at the packaging area. They also have to be shipped from the factory where they are manufactured, to the packaging area, utilizing a large transportation volume.

One solution to the above is to use polyurethane foam, which may be injected into a package that protects the packaged product. The raw material storage and transport volume is relatively small. During injection, the volume increases by 200 in 20 seconds, and no mold is required. Injection can be carried out at the point of packaging. However polyurethane has the problem that it is difficult to dispose of, and many countries do not allow such an environmentally unfriendly way of packaging.

Another way to solve the problem of bulk, is inflated packaging, in which double layer plastic packaging is inflated at the packaging area, for example in a factory, prior to use. Thus handling problems are much reduced. Also, since the packages can be deflated afterwards, the disposal problem is much reduced.

In one available example, the automatic inflation system used inflates the packages to atmospheric pressure so that the packaging cannot be used when high levels of protection are needed which require the drop test standard.

There are a number of examples of inflatable packaging materials. Representative of various of the above are the following U.S. patent documents: U.S. Pat. Nos. 4,240,556; 6,056,119; 5,588,532; 5,620,069; 6,598,373; 5,420,556; 5,445,274; 6,283,296; 6,571,954; 7,168,566; 7,823,729; 7,874,428; and 5,620,096; and U.S. published application 2006/0218879.

Inflated packaging materials have some known advantages. Regarding the handling issue mentioned above, such packaging materials can be stored flat, for example in stacks, or on rolls and occupy little space before inflation. Likewise, the inflated portions or packages, can be deflated after use, for example, by cutting or puncturing, and again occupy little space.

Inflated packages are generally recyclable, and are advantageous in countries and localities that impose strict environmental rules on disposal of packaging materials. Polyurethane foam is not recyclable. Polystyrene foam (EPS) can be partially recycled, although some countries do not allow its use. Polyethylene foam can generally be recycled.

SUMMARY OF THE INVENTION

In applicant's earlier Patent Application No. PCT/IB2012/057244, referred to above, there is disclosed a precursor for an inflatable package, or an un-inflated package, having a plurality of inflatable areas that form panels that can be folded and at least partially wrapped around packaged articles, and one or more sealable inflation ports connected to the inflatable areas and connectable to a source of inflation. There may also be included any of hinge areas between adjacent panels, and connecting passages between upstream and downstream panels and to the inflation ports, and in which the inflated panels are self-folding. There is also disclosed an inflated package formed from such a precursor. The precursors or pre-inflating packaging may be provided in flat stacks or on rolls.

The present invention relates to a device for inflation of such packages, which device can be applied on an industrial scale. As discussed below, aspects of the device relate to accurate handling of the stack or roll to extract a package from the stack etc for inflation, pressurized inflation and then sealing of the package.

In the present disclosure, an un-inflated package is filled with pressurized air through an opening in the package, but unlike in the previous case, inflation is achieved without inserting an inflating means between the two layers of the package.

In the presently disclosed embodiments the pressure level inside the package may be controllable and can be preset to a desired value.

In one particular embodiment no air escapes from the inflating system during the inflation process, as the system is closed and there are no leaks between the lips of the inflator device and the package outer layer.

One of the embodiments, as will be discussed below, and referred to as the double cup device, performs inflation without insertion of an inflating means, controls the pressure and seals the inflating system. As will be discussed in greater detail below, the double cup device has pressurized air in the center and a vacuum ring around it.

In the present embodiments, an inflation device is placed against the inflation port or inflation opening. The inflation device is larger than the inflation port or opening and thus may enclose the port or opening. The inflation device is then connected to a pressure source and air flows freely from the inflation device into the package through the port or opening.

According to an aspect of some embodiments of the present invention there is provided an inflation device for pressurized inflation of an un-inflated package, the package comprising two layers, the layers being generally flat prior to inflation, and an inflation opening of a size up to a predetermined maximum size in the package, the inflation device comprising an inflation tool, for contacting the package at the inflation opening to inflate the package through the inflation opening using inflation fluid from a pressure source, the inflation tool, having an enclosing surface to enclose the inflation opening, the enclosing being external to the package, the enclosing surface covering an area which is larger by a finite amount than the predetermined maximum size.

An embodiment may include a co-operating gripper for gripping the package, wherein the gripper comprises a fingerlike mechanism or a plate or a vacuum gripper or one or more feed wheels.

An embodiment may comprise a region surrounding the inflation tool and delineated by the inflation tool and an outer wall, which is connected to a vacuum source. The inflation tool may comprise an inwardly turning lip with an outwardly turning lip on the outer wall.

The region connected to a vacuum source may be used to pull apart the layers of the package to assist with inflation.

An embodiment includes a stopping element extending across the region connected to a vacuum source, the stopping element being in a retracted position with respect to a plane containing the layers, the stopping element being configured to define a spacing between the layers of the package and thereby to limit ballooning by the package under influence of the vacuum source and air pressure.

The stopping element may be heatable to form a heat seal on the package.

The device may apply a pressure above surrounding pressure to the packaging, the pressure being one member of the group consisting of: a predetermined value, a value in excess of 0.1 bar, a value between 0.1 and 0.9 bar, and a value at a controlled amount between 0.1 bar and 0.9 bar.

The device may check a pressure applied to the package prior to sealing of the package.

In an embodiment, the enclosing inflation tool comprises one member of the group consisting of a flat plate enclosing the opening and an inwardly extending shape enclosing the opening.

An embodiment may comprise a second inflation tool and a second surrounding vacuum region, configured to contact the package from an opposite side.

The second surrounding vacuum region may cooperate with the first surrounding vacuum region to pull opposite layers of the package respectively apart.

A plurality of un-inflated packages in stacks may be fed using a feeder mechanism c to feed packages from each of the stacks upon request, to the inflation device for inflation.

An embodiment may inflate a package having a second opening opposite the inflation opening, the device comprising a cone for location of the second opening thereon. The cone may comprise a recess facing a source of the inflation fluid, the recess being configured to direct the inflation fluid outwardly into the interior of the package.

The device may obtain the package from a stack aligned using stack alignment pins.

The device may be mounted on an arm, say a robot arm, or may be designed to be handheld.

The device may be used for inflation of an inflatable package, and the invention extends to a package with an inflation opening, when inflated using the device, and to a package with an inflation opening, when inflated and sealed using the device.

According to a second aspect of the present invention there is provided a method of inflating a package having an outside and an inflation opening, the method comprising:

enclosing the inflation opening from the outside to form an external enclosure; and applying pressurized fluid to the external enclosure, the pressurized fluid thereby inflating the package via the inflation opening.

Suction may hold and/or lift the package during the inflating.

Heat-sealing may be applied to the package channel downstream of the inflation opening or surrounding the inflation opening to seal the package after the inflation.

Suction may be provided circumferentially around the enclosing inflation tool.

Heat sealing may involve heating a surface around the opening and pressing the package against the heated surface.

The method may include obtaining the package from a stack of packages aligned using alignment pins, and/or feeding the package for inflation from one of a plurality of stacks using a feeding mechanism, and/or providing in the package a continuous inflation region surrounding the inflation opening.

According to a third aspect of the present invention a system for inflating packages comprises:

the inflation device as above, a mounting having an arm for movably mounting the inflation device, and a stack holder with alignment pins for holding pre-inflated packages for inflation by the inflation device.

According to a fourth aspect of the present invention a system for inflating packages comprises:

the inflation device as above, a plate for holding a package against the inflation device, the plate comprising a ring to surround the inflation opening to heat seal the package after inflation.

According to a fifth aspect of the present invention a system for inflating packages comprises:

the inflation device as above, and a plate for holding a package against the inflation device, the plate being mounted to swivel.

According to a sixth aspect of the present invention a system for inflating packages comprises:

the inflation device as above, a pressure source, and a vacuum source.

According to a sixth aspect of the present invention a system for inflating packages comprises:

the inflation device as above, the system being configured to find and pick up packages for inflation based either on the packages being placed according to predetermined alignments or based on outline detection or using a detectable mark on each package.

In an exemplary embodiment of the invention, there is provided an inflatable package, comprising an inflation port in the form of an aperture, surrounded by a continuous inflatable area, inflated via the aperture. At least, in some embodiments, at least 290, 310, 340 or intermediate degrees of the surrounding (when measured as projected on a bounding circle) are inflatable.

In an exemplary embodiment of the invention, there is provided an inflatable package, comprising an inflation port in the form of an aperture, and having an adhesive patch covering at the port. Optionally, the port comprises aperture sin opposing layers and two adhesive patches are provided one on each aperture.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
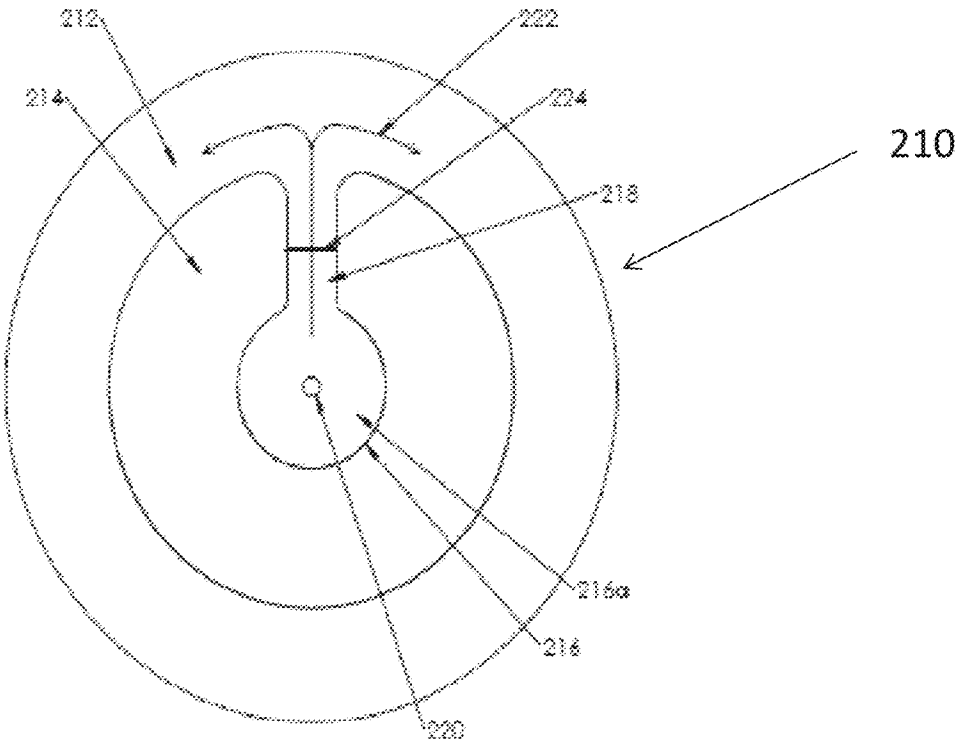
FIG. 1 is a simplified drawing illustrating an inflatable package of the kind that may be inflated using the present embodiments.

The present invention, in some embodiments thereof, relates to an inflator and, more particularly, but not exclusively, to an inflator for pressurized packaging that can be used for protecting products, in particular where a drop test standard applies.

Applicant's earlier International Patent Application No. IB2012/057244 referred to above provides numerous designs of packages or package precursors, but inflation requires insertion of a needle or engagement with a specially-shaped inflation nipple or inflator body and this makes it difficult to carry out inflation automatically, rapidly and on an industrial scale using a cost-effective device.

The present embodiments use an enclosing nozzle-type structure, or inflation tool, to come into contact with the inflation opening. By the term "enclosing" is meant a structure that encompasses the inflation opening so that the opening is fully covered, and may include for example a concave nozzle or bell shape, or a slightly concave or even a flat plate, provided that they extend beyond the boundaries of the inflation opening and therefore enclose the opening. The enclosing structure, referred to also herein below as an inflation tool, or alternatively a cup or a nozzle, obviates the need for a needle or other insertion device for inflation. An inflation port, or inflation opening or hole, is provided anywhere on the package and two pins may be provided to align the stack of un-inflated packages with the inflation tool, for example the concave structure. The pins or any other alignment method allow the system to know where the inflation opening is and thus may ensure that the inflation opening falls within the circumference of the inflation device. The circumference of the inflation device, whether concave structure or cup or flat plate, is larger than the opening by a finite amount and to any extent practical, so as to improve the chances of successfully covering the opening.

Inflation is carried out by applying a pressurized air source to the inflation tool, air freely entering the inflation opening from the inflation tool. There is thus no need for an inflation needle or other insertion structure to be positioned for insertion between the layers of the packaging.

Although the term "circumference" is used, inflation device need not necessarily be round, and the reference is to the outer walls of the inflation tool irrespective of its cross-sectional shape.

Hereinafter, reference is made to pressurized air and air pressure. It is understood that any inflation fluid that can pressurize a void is intended.

An optional double cup design of the inflation tool allows for suction to grip and/or lift and hold the package and in a further option allows for post-inflation sealing, so that a single grip action by a robot arm may capture, and lift the package precursor, inflate and seal and then release the ready to use package.

The inflation tool may be constructed from an elastic material, to allow it to deform when pressed against the package.

Figure 15:
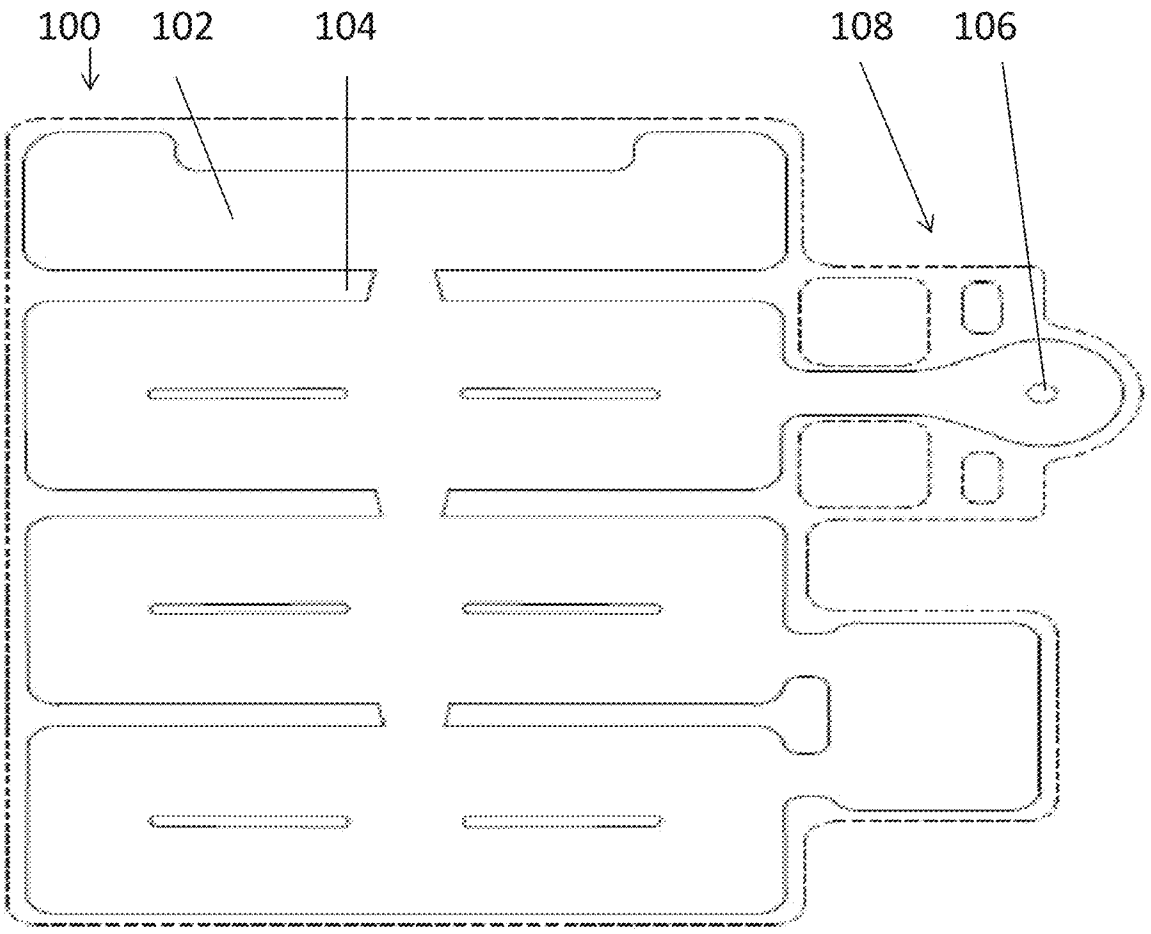

For purposes of better understanding some embodiments of the present invention, reference is first made to the construction and operation of the package provided in applicant's earlier application referred to above, as illustrated in FIG. 1, which is the same as FIG. 15 of applicant's earlier application. A single panel is illustrated for simplicity of description, but it should be understood that multiple panels may be provided in one or more parallel rows along the length of a sheet or roll.

Panel 210 includes an inflatable area 212 surrounding an un-inflatable area 214, which in turn, surrounds an inflation opening or inlet 216 that is connectable to the source of inflation fluid. Inflation area 216 includes a central inlet area 216*a*, and a connecting passage 218 through which inflation fluid is provided to inflatable area 212.

As described in the prior application, inflation fluid was provided through a needle such as used to inflate a basketball, indicated at 220, that pierces inflation inlet area 216*a* for example, from above, i.e., into the plane of the drawing. Alternatively, a preformed opening, which would also be located at location 220, was suggested in inlet area 216*a*.

Inflation fluid was explained to pass to inflatable area 212 along the path indicated by arrow 222. After inflation, connecting passage 218 was sealed by a transverse bond line 224, for example by heat sealing using opposing jaws, or otherwise as previously described. With such an arrangement, inlet area 216*a* does not need to be sealed.

The use of a needle requires exact alignment of an inflation device with the inflation opening, and thus makes it difficult to design an automatic device that is reliable and cost-effective. However, it is noted that no alignment is required if the needle pierces the package.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 2:
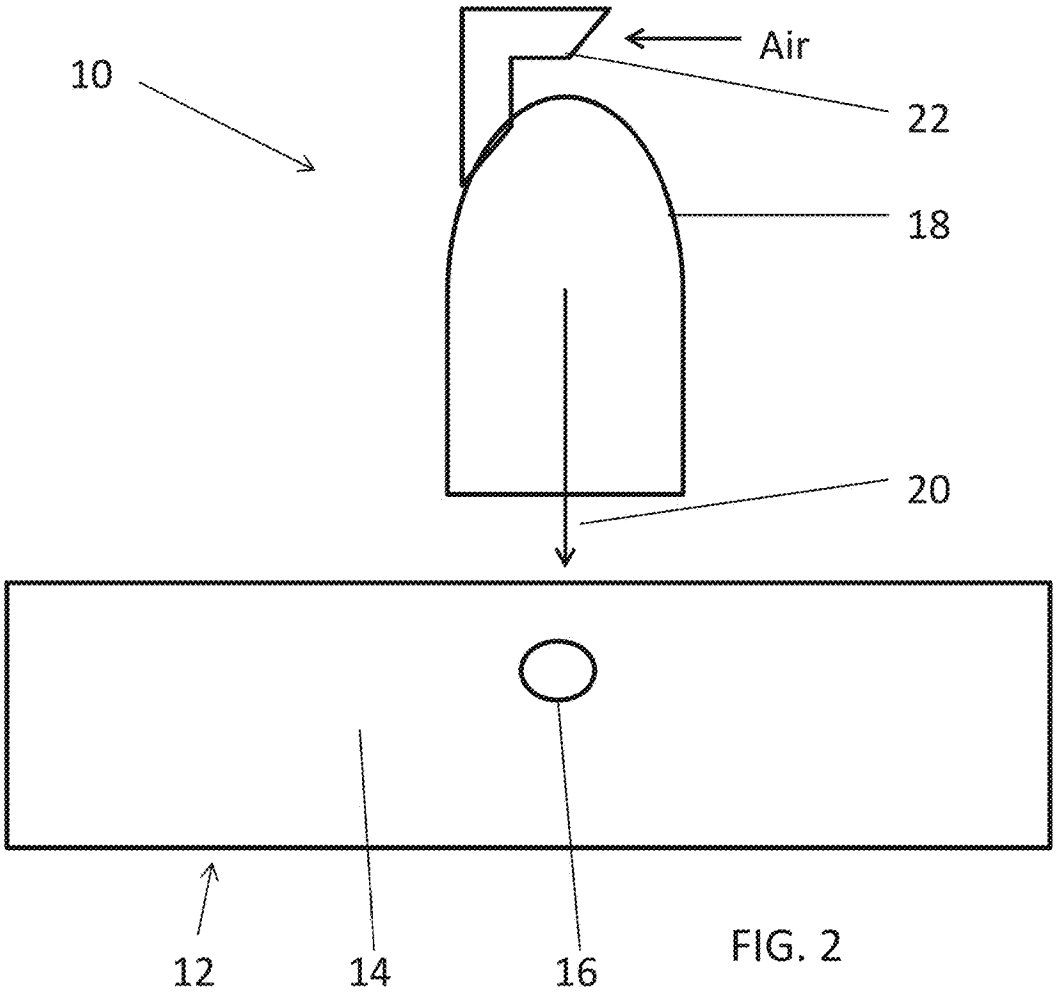
FIG. 2 is a simplified schematic diagram showing an inflation structure according to a generalized embodiment of the present invention.
Figure 3:
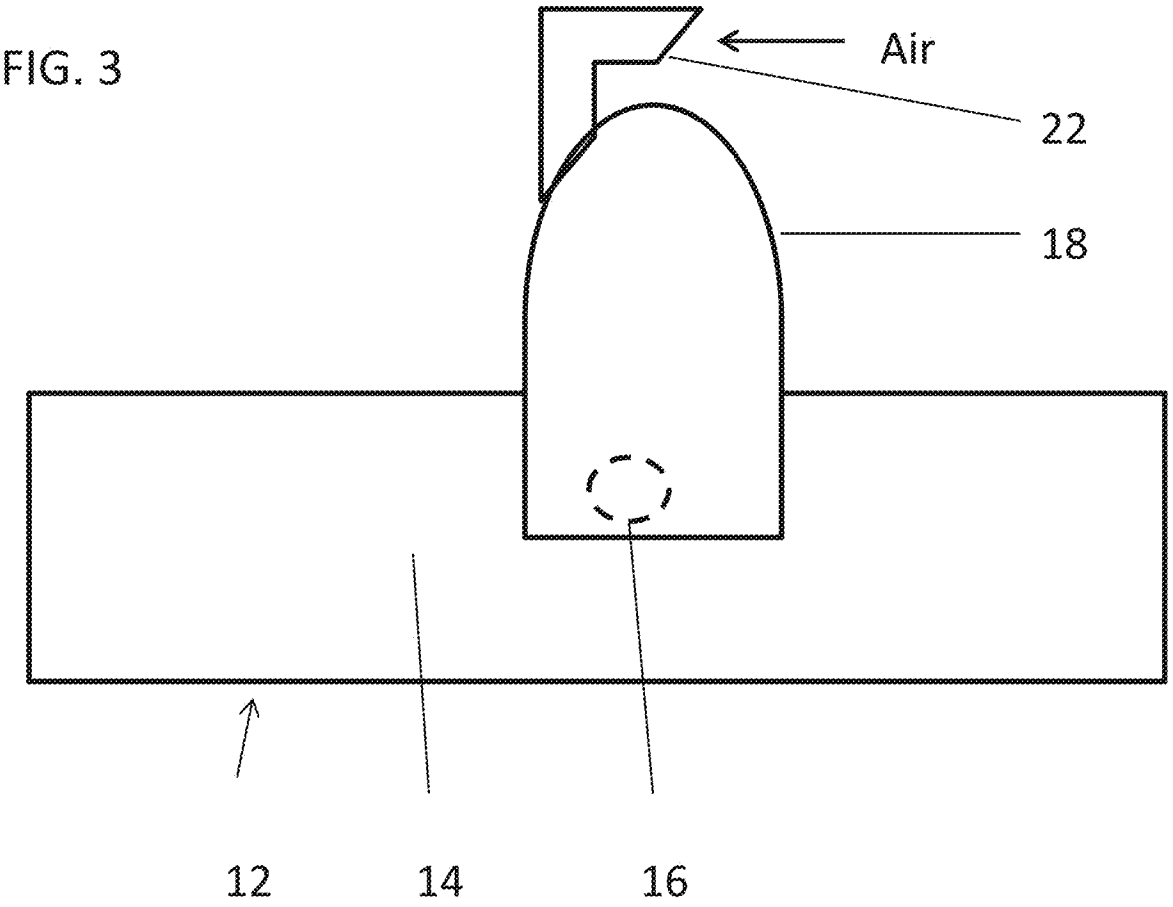
FIG. 3 is a simplified schematic diagram showing the structure of FIG. 2 in contact with a package to be inflated.

Referring now to the drawings, FIG. 2 is a schematic diagram that illustrates an inflation device 10 for pressurized inflation of a package or package precursor 12. By the term package precursor is meant the ready to inflate flat package prior to inflation, and the terms "package precursor" and "pre-inflation package" are intended to be synonymous. The package precursor 12 has two layers, an upper layer 14 and lower layer, both of which layers are generally flat prior to inflation. An inflation opening 16 is located in the flat upper layer. The inflation opening may be of any size up to a preset maximum size that the device can deal with. The inflation opening is shown as being round in shape but the shape is not critical and examples may be square or rectangular or polygonal, or even 'X' shaped. The inflation device 10 has a concave or nozzle-shaped structure 18 which moves in the direction of arrow 20 to come into contact with the package at the inflation opening 16. FIG. 3 shows a concave inflation device in contact with the package. When in contact with the package, pressurized air is provided, for example through pipe 22 and inflates the package through the inflation opening using air from an air pressure source. The inflation device is, in this example, constructed with an enclosing internal surface with which the structure is able to cover the inflation opening. The internal opening of the inflation device covers an area which is larger by a finite amount than the preset maximum opening size, so that even with inaccurate placement the opening is still covered and inflation still works.

It will be appreciated that instead of the inflation device approaching the package, the package may approach the inflation device. Alternatively both the package and the inflation device may be moved together towards each other.

The inflation device is typically bell-shaped, or cup shaped, but may be any other shape that encloses the inflation opening with a margin of error.

Figure 4:
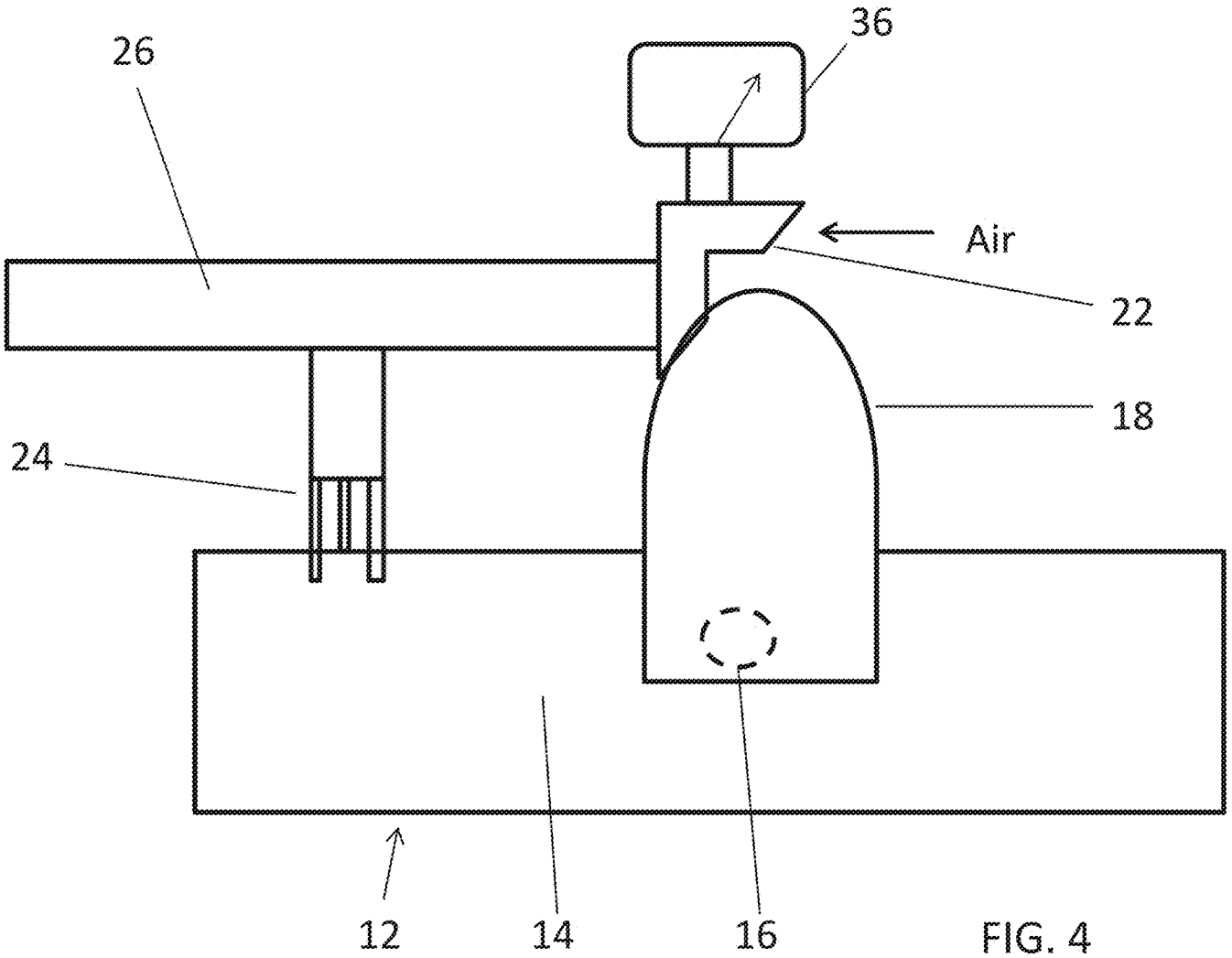
FIG. 4 is a simplified schematic diagram illustrating the structure of FIG. 1 with an external gripping device.

Referring now to FIG. 4, in order for the package to inflate rather than be blown away by the air pressure, the package may be held by a grip, for example a mechanical gripper 24,—which may be a fingerlike device for gripping a package and transferring it. A surface such as a table may be provided behind the package. In some cases the package is provided to the inflation device from a stack, so that the packages remaining on the stack provide backing against the inflation. FIG. 4 relates to an embodiment in which the gripper is separate from the inflation structure. The separate gripper may be mounted on a robot arm 26, which may be the same robot arm that the inflation device 18 is mounted on. The gripper may be used both for picking up the package from a stack or roll and moving it towards the inflation device, and for holding the package against the inflation air pressure. As illustrated, the gripper 24 comprises a robot holder, but it may include a plate that picks up packages from the stack and lifts them into position, or a vacuum gripper. The plate may be in addition to, or instead of, a holder or a vacuum gripper. In order to hold the package against the inflation pressure it is preferable to hold the package against the inflation structure from the opposite side to that in contact with the inflation device, and this is achieved most easily by a plate, so that the plate is actually a counter surface, or reaction surface, in this respect.

In a variation, the gripper may be an arrangement of wheels (in the feeder), or wheels and suction devices as used in a printer or photocopier to feed paper.

As mentioned, the packages may be in stacks. There may be different stacks, each with different shaped packages. The device may select packages from different stacks for inflation as needed, the device either rotating to meet each stack or the feeder being designed to select from the appropriate stack, for example in the same way that paper feeds select sheets from different trays. The selection process may be under computer control.

The packages may be aligned using pins. Two pins holding the packages may indicate to the device the position of the inflation opening. Using such a system, the inflation opening can be positioned where desired and the inflation structure will be able to align itself with the opening. The pins are shown in FIGS. 21 and 22, which are discussed below.

Figure 21:
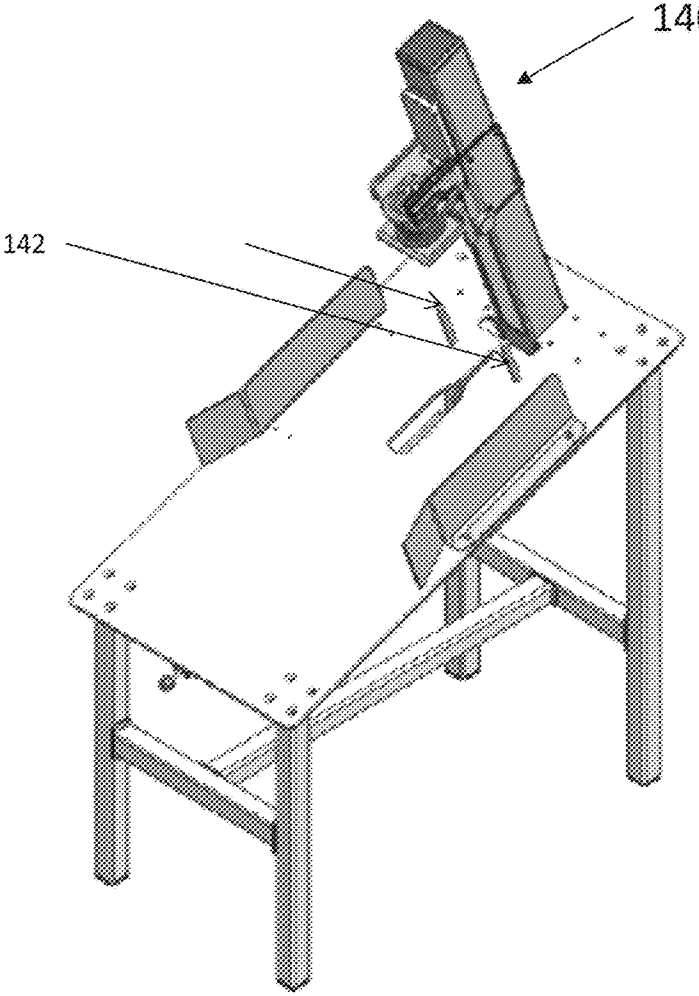
FIGS. 21-22 show an alternative embodiment of the inflation device of FIG. 19 in which location pins are used to align stacks of packaging.
Figure 22:
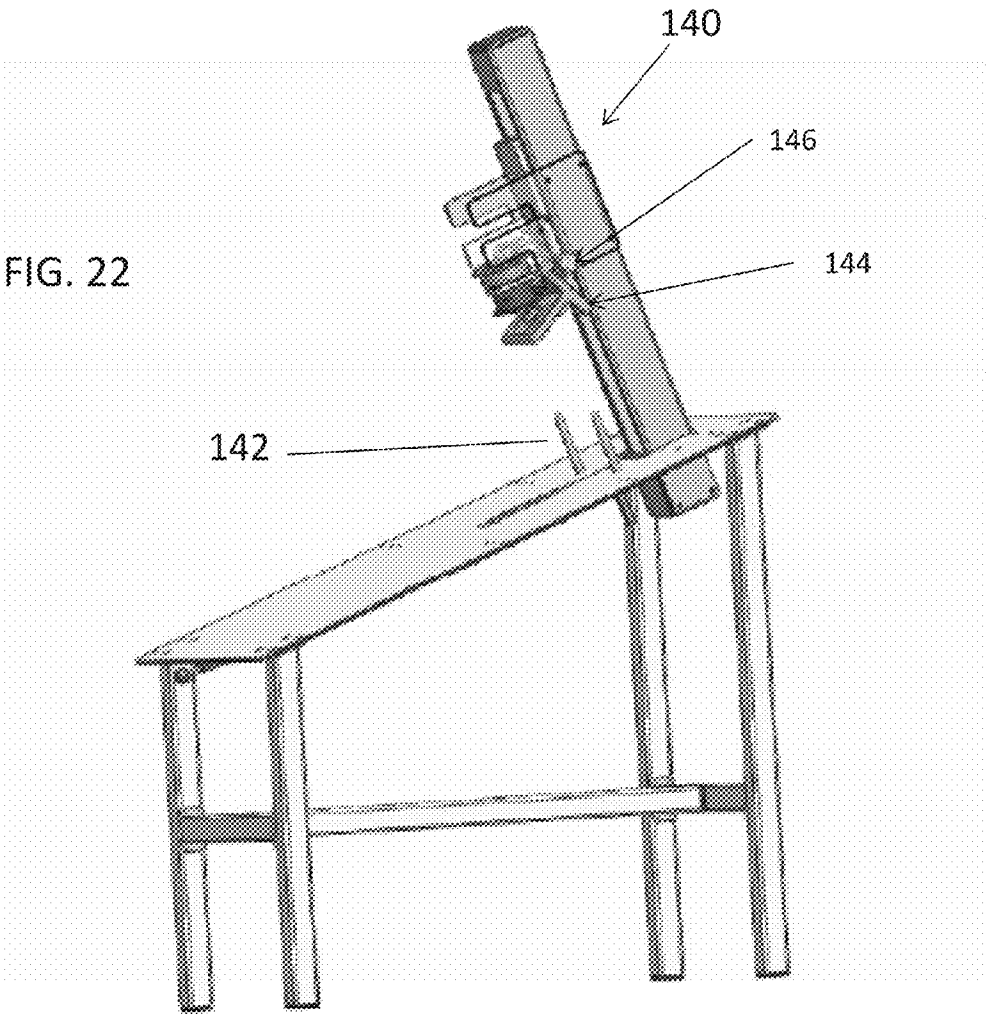

The two pins shown in FIGS. 21 and 22 are merely one possible way to align the stack of un-inflated packages with the inflation device. Other solutions may include using the package borders, or putting a mark on the package and using a photoelectric sensor to detect it.

Figure 5:
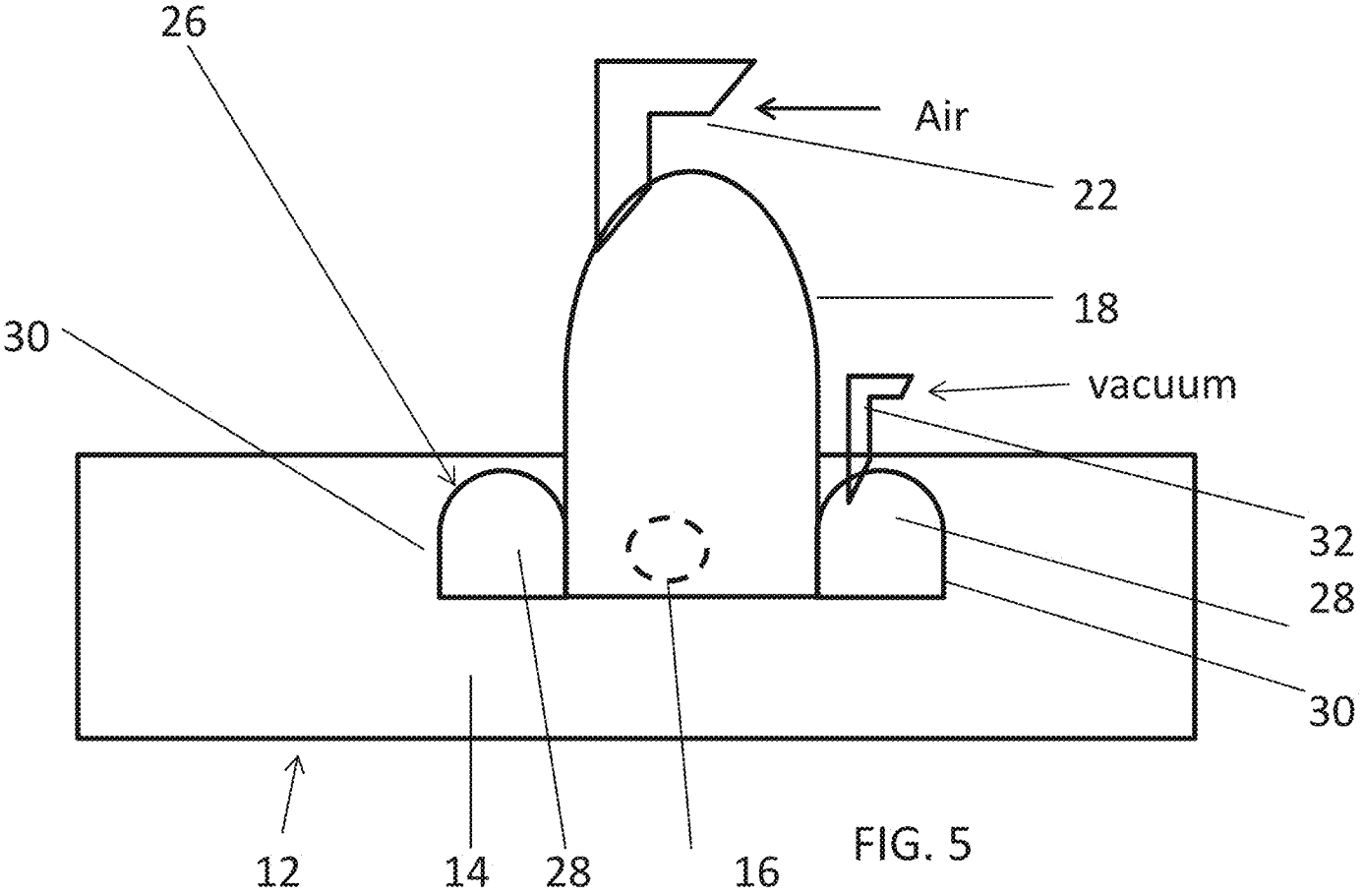
FIG. 5 is a simplified schematic diagram illustrating the structure of FIG. 1 with an integral gripping device.
Figure 10:
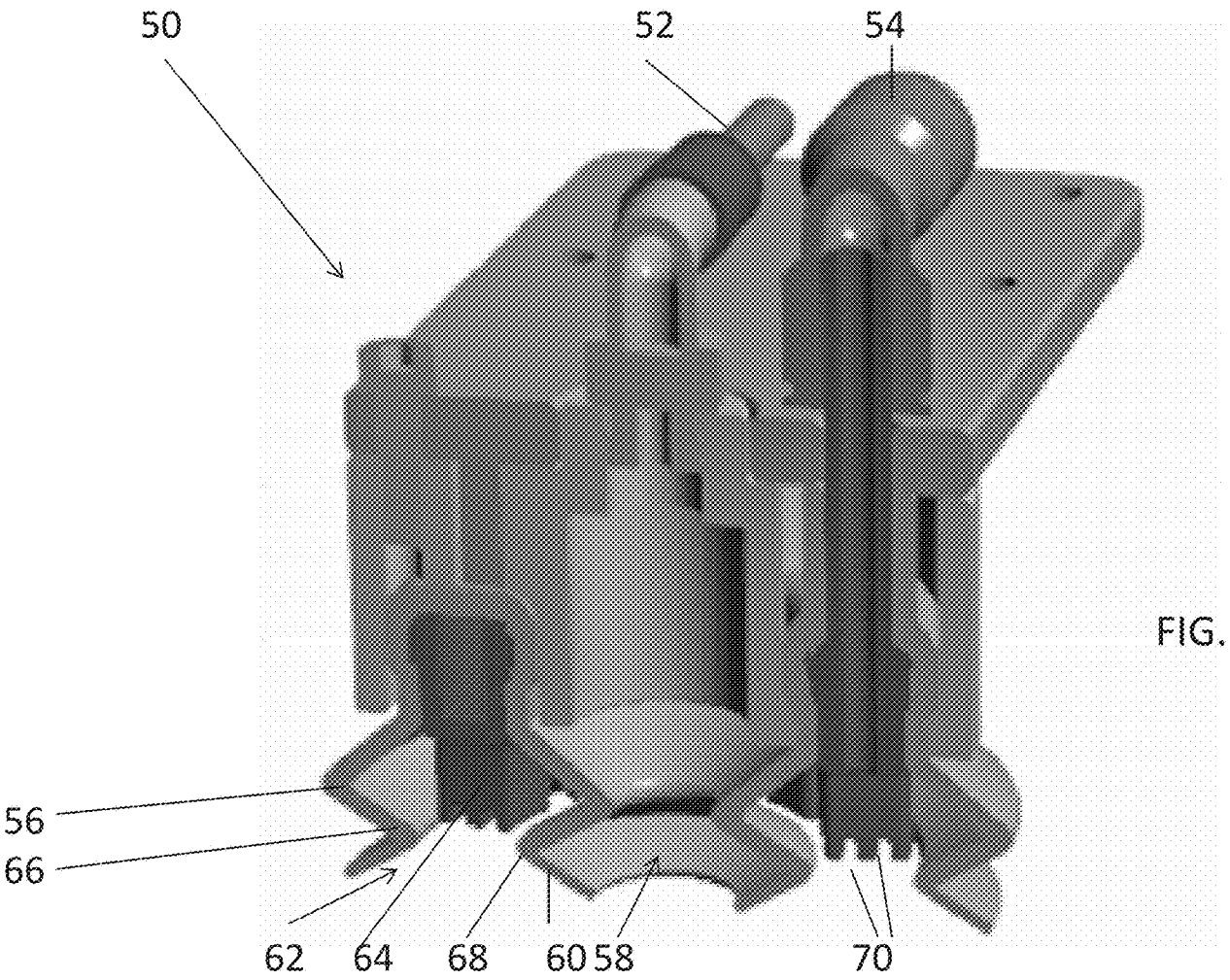

Reference is now made to FIG. 5, which shows an embodiment in which the gripper is built integrally with the inflation structure. A vacuum gripper 26 comprises a region 28 surrounding the inflation structure 18 and delineated on either side by the inflation structure and an outer wall 30. The delineated region is supplied with a vacuum from a vacuum source, typically via pipe 32. As the package is approached, the vacuum is applied and the gripper seizes the package material around the inflating device. The vacuum keeps the inflating device in contact with the package. Since the outer lip of the vacuum gripper points outwards, as shown in FIG. 10, the outside atmospheric pressure pushes the lip against the package so that no air can flow from the outside into the vacuum area. Likewise, since the internal lip of the inflation device points inwards, the pressurized air pushes this lip against the package so that no air can flow from the pressure side to the vacuum side. Thus in effect, no air escapes into the surrounding atmosphere during the inflation process.

Figure 6:
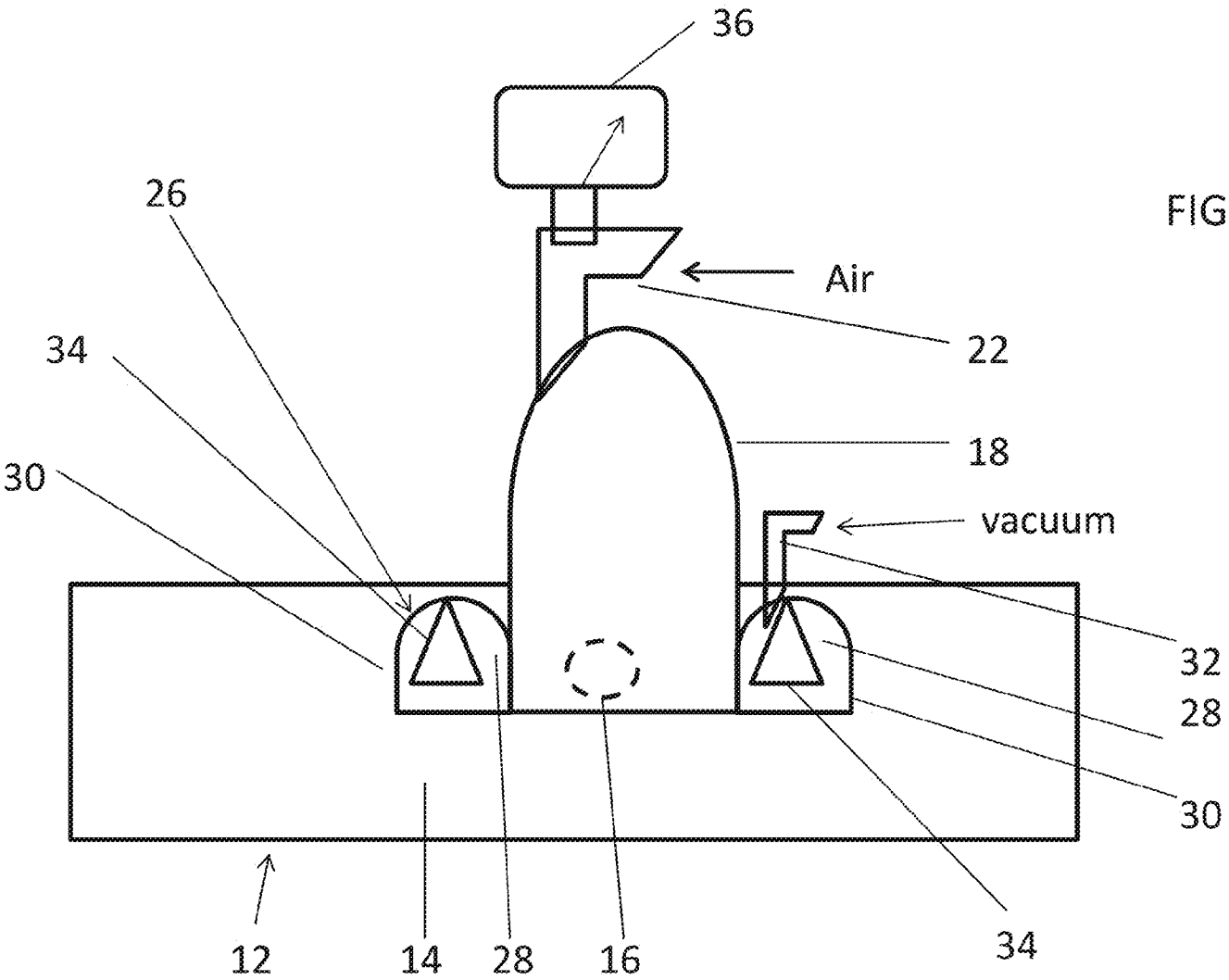
FIG. 6 is a simplified schematic diagram illustrating the structure of FIG. 5 with an internal stopping surface within the integral gripping device.

Referring now to FIG. 6, the vacuum gripper 26 may include a stopping structure 34 within the region 28. The stopping structure is located in a retracted position with respect to a plane containing the un-inflated package and limits ballooning of the package under influence of the vacuum source and the inflation itself. In other words the stopping structure prevents the package wall being pulled out by the vacuum too far into the region 28. During ballooning, the package upper sheet may be sucked into the vacuum space and may block one of its compartments. Grooves are therefore provided at the contact surface of the space to allow air flow between compartments. Ballooning is caused by the inflation and may results in ripples which prevent a good seal. A spacer, such as the stopping structure 34, keeps the upper layer from ballooning.

In an embodiment, the stopping structure 34 can be heated to provide a heat seal to the package. The heat seal may be in the shape of a ring around the inflation opening so as to isolate and seal off the inflation opening from all inflated cushions in the packaging.

The vacuum gripper vacuum combined with the shaped lips as discussed above, has the effect of substantially sealing the inflation structure to the package so that inflation can occur in a controllable manner with no air escaping. Without the vacuum gripper some air may escape but inflation may still work. With the vacuum gripper, packages may be inflated to their design pressures for use, and the inflation device may be set to provide such design pressures. Typical pressures currently in demand, given in bars above surrounding atmospheric pressure are 0.1 bar, and 0.9 bar and anything in between. A device according to the present embodiments may provide a program-defined pressure at a controlled level as desired, typically between 0.1 bar and 0.9 bar. In order to provide a defined pressure, a pressure gauge 36 may be added. Although the gauge is only shown in FIGS. 4 and 6, it is relevant to all embodiments. Although the gauge is shown with a readout scale, it typically interfaces with the internal electronics and the readout scale is merely optional. The pressure gauge may typically check the pressure applied to the package prior to sealing, so as to apply any corrections.

Figure 7:
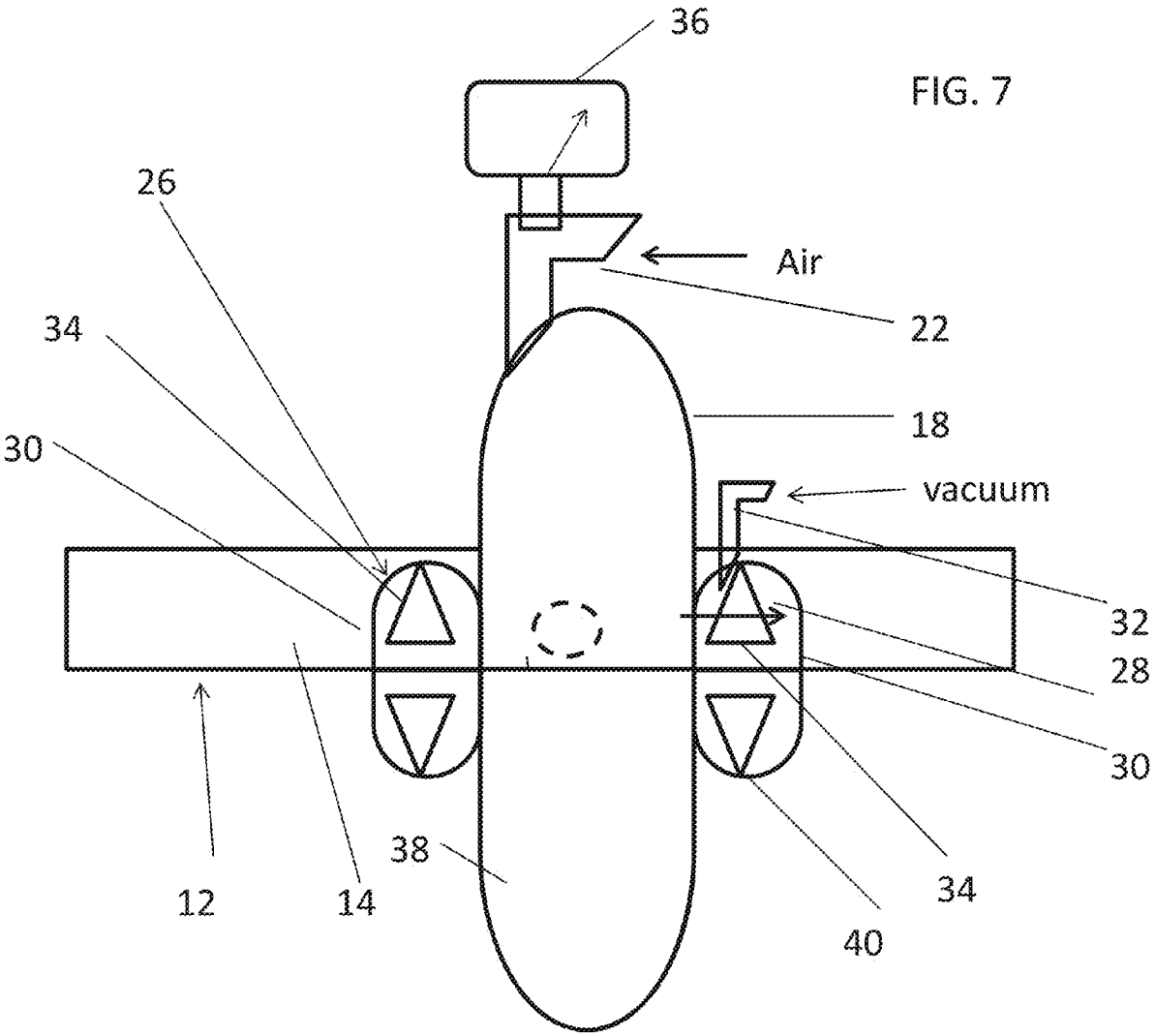
FIG. 7 is a simplified schematic diagram of a variation of the structure of FIG. 6, in which inflation and gripping elements are provided for both layers of the package.

Referring now to FIG. 7, a second inflation device 38 and optionally a second vacuum gripper 40 may be in contact with the package precursor 12 from a second, opposite, side. The second gripper is useful for pulling apart the two walls of the packaging to assist with inflation, and the second inflation structure is helpful in the case where the inflation opening extends through both walls of the packaging. In package manufacturing, it is far easier to make an opening that penetrates both walls of the package than to make an opening in one wall only. Although the double sided embodiment is illustrated with the vacuum gripper and the heating surface, it is relevant for the embodiments of each of FIGS. 1-5 above as well. The double-sided structure is helpful for easy opening of the package. The two vacuum grippers may pull the two walls of the package apart to allow for effective inflation.

Figure 8:
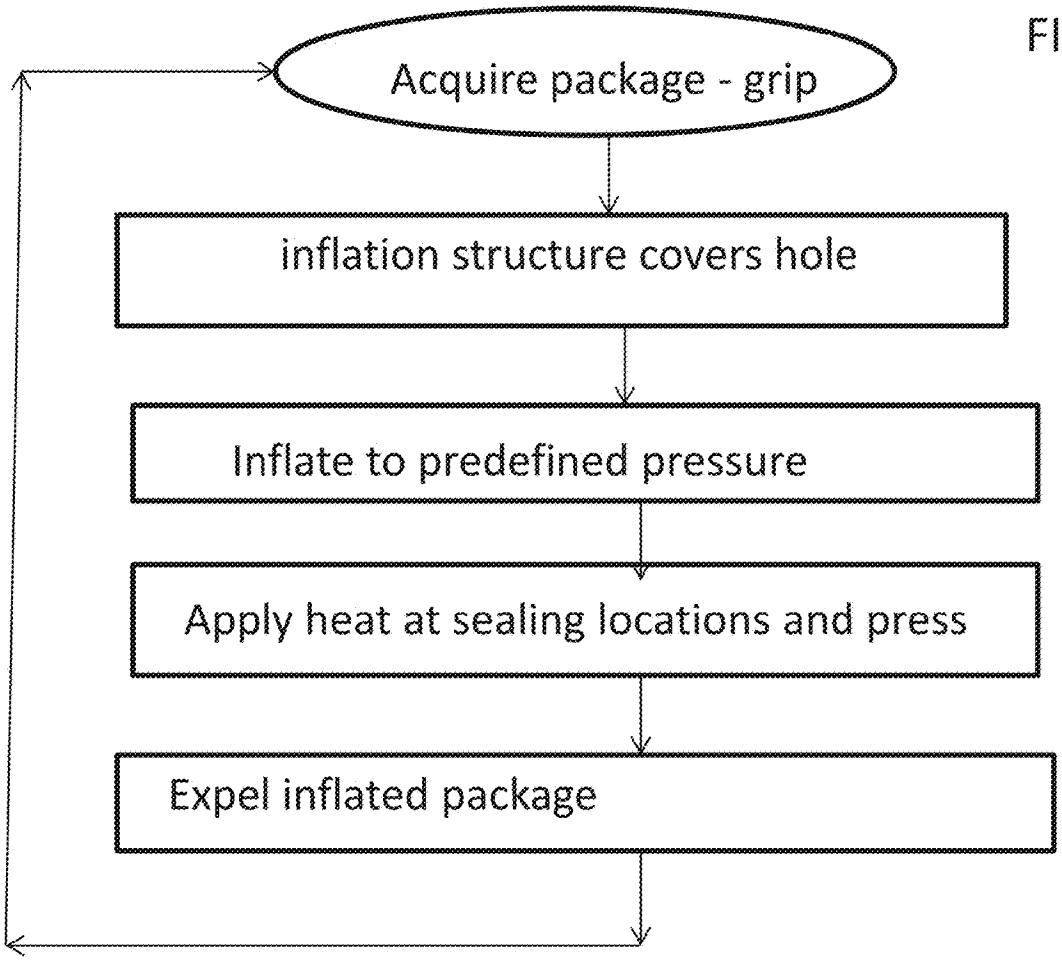
FIG. 8 is a simplified flow chart illustrating a procedure for using an inflation device according to an embodiment of the present invention.

Reference is now made to FIG. 8, which is a simplified flow chart illustrating use of an inflation device according to the present embodiments to inflate a package or package precursor prior to use. Operation of the device involves acquiring say by lifting or moving, the package or package precursor, and further determining the approximate location of the inflation opening, for example using the pin structure referred to above. The inflation device, which is connected to a pressure source, is located against the inflation opening. As discussed, the concave shaped structure covers an area larger by a finite amount than the maximum size of the inflation opening so that the inflation opening is wholly covered within the concave shaped structure, even though the package and structure do not locate on each other precisely. The package is then inflated through the inflation opening by applying pressurized air to the concave structure. The air, or for that matter any other pressurized inflation fluid, flows through the inflation opening. As discussed, if vacuum gripping is used then air does not escape during the inflation process, but if other forms of gripping are used then air may indeed escape. The reduction in efficiency caused by escaping air is however not critical, as long as the back of the package is well held.

If vacuum gripping is used then the vacuum is preferably applied first, prior to applying the pressurized air. If both sides are held, as in the embodiment of FIG. 7, then suction may be applied on both sides to pull apart the two opposing walls of the package.

Following inflation, the package may be heat sealed. As discussed, the vacuum grippers may contain the heating elements. In such a case the heating elements are heated following inflation, and optional measuring of the package pressure, and then the two walls of the package are pressed together, for example by lowering the heating elements to the original plane of the package.

Figure 9:
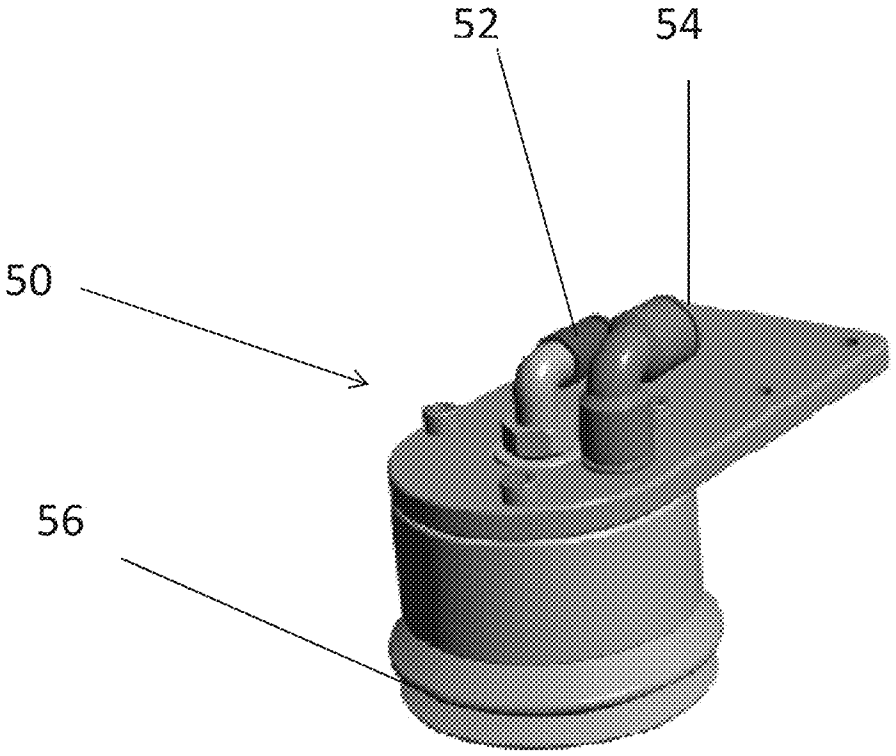
FIGS. 9-11 are 3D schematic drawings of the structure of FIG. 6.

Reference is now made to FIG. 9, which is a simplified schematic three-dimensional drawing of the inflation device of FIG. 5 or FIG. 6. The inflation device 50 has two tubes 52 and 54. The central tube 52 is for connecting a pressure source to the inflation structure, and the outer tube 54 is for connecting a vacuum source to the vacuum gripper. The outer walls 56 of the vacuum gripper are seen.

Reference is now made to FIG. 10 which is a cross-sectional view of the inflation device 50 of FIG. 9. The inflation device 50 has two tubes 52 and 54. The central tube 52 is for connecting a pressure source to the inflation structure, and the outer tube 54 is for connecting a vacuum source to the vacuum gripper. The outer wall 56 of the vacuum gripper form a "W" shape. The inflation structure 58 is defined by outer wall 60, also in a "W" shape, to define a two-part interior, referred to as a double cup. The outer wall 60 also serves as the inner wall of the suction gripper 62. Stopper 64 sits within the suction gripper 62 and prevents the package material from ballooning into the gripper space, as discussed above. The stopper 64 may be positioned a few millimeters above the upper package layer. The stopper 64 may have protruding ridges 70 and crossing grooves—not shown but needed to connect between the two vacuum compartments. The vacuum gripper has a bend 66 in its outer wall to form a lip pointing outwards as it approaches the package. Likewise, the inflation device may have a bend 68 in its outer wall to form a lip pointing inwards as it approaches the package.

As mentioned above, both the internal inflation nozzle 58 and the outer suction ring 62 are provided with a 'w' shape to allow them to expand and contract. This construction ensures that the lips of both are always in contact with the package during inflation.

Both the 'w' shaped walls 58 and 66 may be constructed using soft flexible rubber or silicone. This too ensures contact with the package.

Since the lips of 58 are pointed inwardly, the pressurized air inside 58 pushes these lips against the package thus preventing pressurized air from being sucked into the vacuum chamber 62.

Similarly, since the lips of the vacuum chamber 62 are pointed outwardly, the external pressure of the surrounding atmosphere pushes these lips against the package thus preventing outside air from being sucked into the vacuum chamber.

Figure 11:
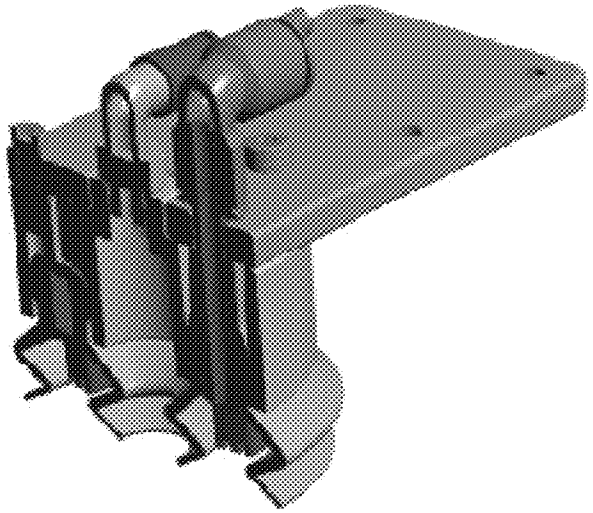

FIG. 11 is a perspective view of the cross-sectioned inflation device of FIG. 10, illustrating in particular how the vacuum gripper surrounds the inflation structure.

Figure 12:
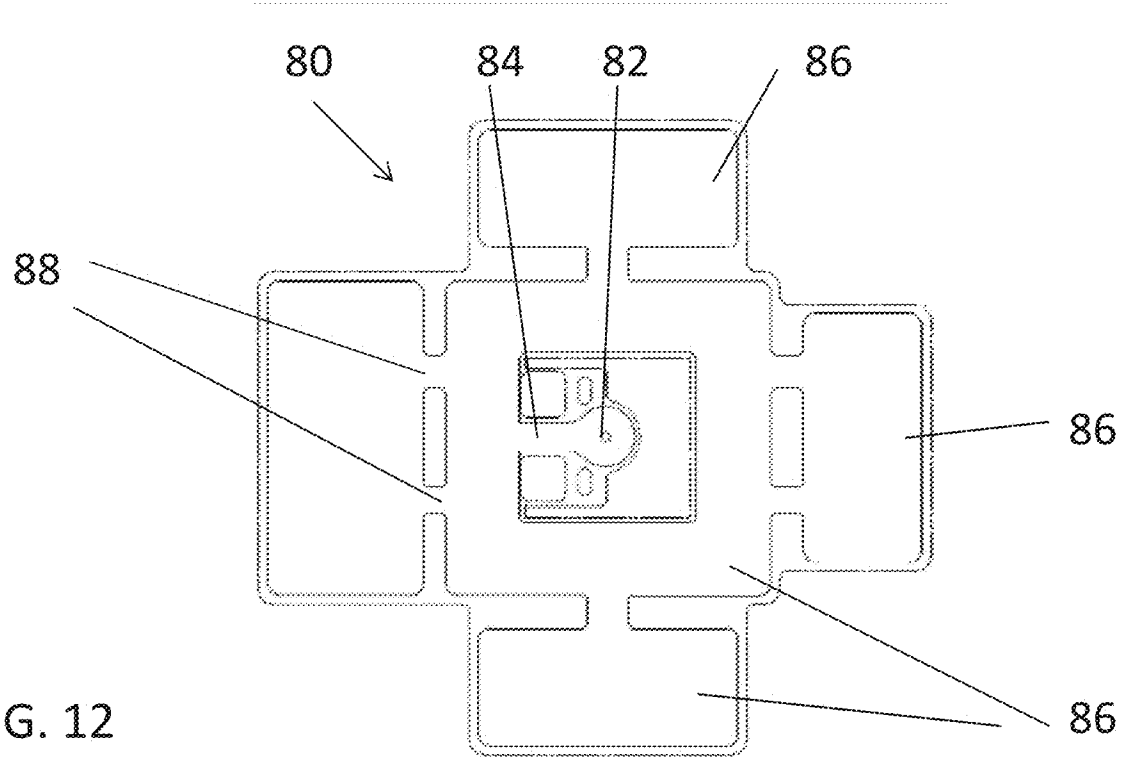
FIGS. 12-15 are schematic illustrations of different exemplary package designs that may be inflated using a device according to the present embodiments.

FIG. 12 illustrates a package precursor 80 suitable for inflation using the present embodiments. In FIG. 12, inflation opening 82 is located at the center of the package, and an air channel 84 leads from the inflation opening to inflatable cushions 86 located around the package. Air channels 88 connect between the inflatable cushions, and the overall shape is designed to be fitted around a specific product. The use of the air channels 88 allow a single inflation point to inflate a package such as package 80 where a complex layout of inflatable cushions is required. The seams defined by non-inflated areas between the cushions allow the package to be folded around a product.

Positioning holes 89 allow the package to be stacked on stacking pins, such as the pins 142 shown in FIGS. 21 and 22 below.

In general the packages are designed for the specific product, and thus the inflation device is required to inflate packages of a wide variety of shapes, generally not known at the time that the inflation device is purchased.

The package precursor 80 may be sealed following inflation by a simple short seam across channel 84.

Figure 14:
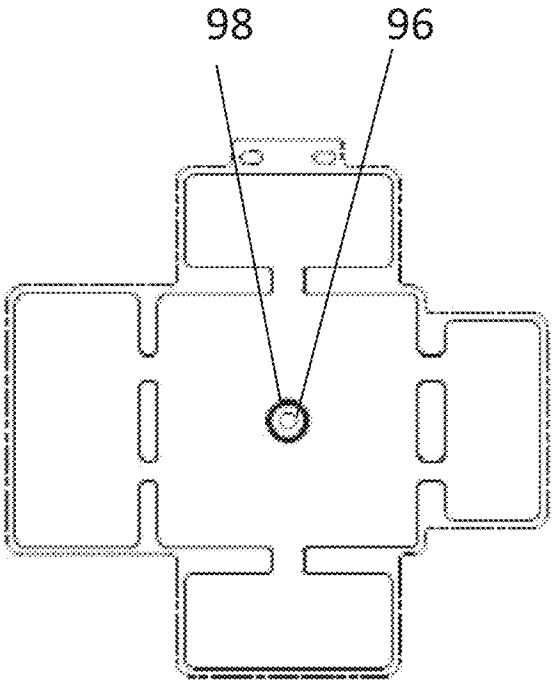
Figure 13:
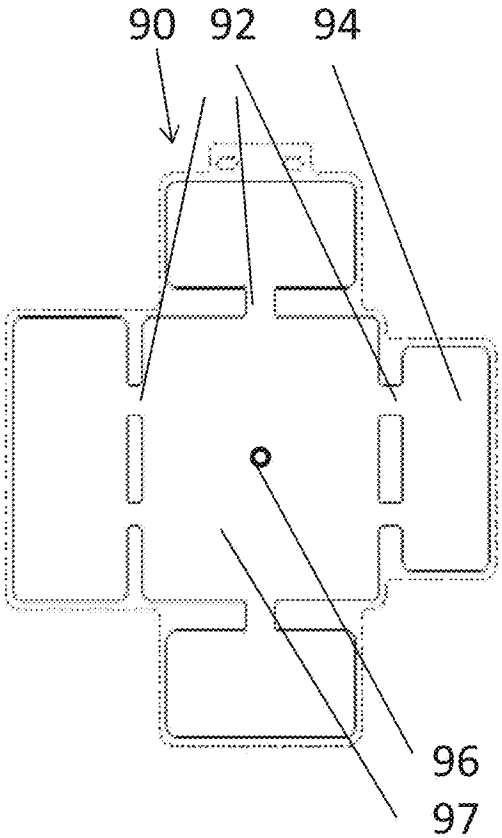

Reference is now made to FIGS. 13 and 14, which are two views of an alternative package precursor 90. As shown in FIG. 13, the package precursor has passages 92 into different inflation cushions 94. Inflation opening 96 is located in central packaging area 97. As shown in FIG. 14 the inflation opening 96 is placed in the center, in a part which would otherwise be part of the central inflation cushion. After inflation a seam 98 is placed as a ring around the inflation opening, and the area within the ring remains uninflated. Inflation may be carried out while the two layers in the center are held close to each other, for example a few millimeters apart.

The inflation opening 96 may be completely surrounded by a continuous inflation region, as per region 97 in FIG. 14. Contrary to what is shown in FIG. 14, the region 97 may be in the shape of a ring or any other suitable shape. As discussed elsewhere, shapes may be selected based on the product to be packaged.

Reference is now made to FIG. 15, which illustrates a further alternative to the package precursor of the preceding figures. Package precursor 100 includes inflatable cushions 102 and foldable hinges 104 in the same way but the inflation opening 106 is on protrusion 108 at one side of the package.

Positioning holes 109 allow the package to be stacked on stacking pins, such as the pins 142 shown in FIGS. 21 and 22 below.

As discussed, inflating is achieved by causing air to flow under pressure through an opening or inflation opening in an un-inflated package without the need to insert an inflating means between the two layers of the package.

The inflation opening or filling port is located either in one or in both layers of the un-inflated package.

The filling opening may be positioned in the center of a round or otherwise shaped filling configuration which in turn is connected to a channel that leads the air into the areas designed to be inflated. The channel can be divided into several sub channels.

The above-mentioned filling configuration may be located anywhere in the package, not necessarily at the center or near the edge as in the above figures.

Inflating may be carried out using an enclosing inflation device as discussed presented to the surface of the package. The inflating structure may be a cup, a cup with a tube inside or a double-cup as explained.

The inflating structure may be placed perpendicularly to the package surface for inflation.

During inflation, all the air goes into the inflated package, as typical with the vacuum gripper. In one variation of the single cup embodiment, a single cup initially uses vacuum to lift up the un-inflated package and put it on a base of some sort. Then pressurized air is applied through the same cup to inflate the package.

After inflating, the channels may sealed by either welding, or heat-sealing, as discussed above. Alternatively non-return valves may be used.

The air pressure in the inflated package may typically be 0.1-0.9 bar above atmospheric pressure and the pressure may be set or adjusted to a specific desired value as discussed, which pressure may be checked prior to sealing.

The package or package precursor attains its final shape for use after inflation. When packages are inflated from a stack there is no scrap material removed. When packages come in a roll the surrounding scrap may need to be discarded. The final shape may be regarded as the package shape ready for use without any scrap.

The present embodiments allow inflating of packages with configurations customized to specific products.

The un-inflated packages can be either stacked one on top of the other or rolled in a roll when fed into the inflator.

If the packages are retrieved from a stack, there is no need to carry out separate alignment for each package since all packages on the same stack are similarly aligned.

As there is no penetration of the package walls, the inflation process is independent of the material thickness.

As explained, the inflation device does not have to be accurately positioned on the package.

The inflating structure may include variations as follows:

Cup and tube. Most of the inflating air flows into the package but some escapes into the atmosphere.

Cup without a tube. The air flow is the same as with a tube.

Double-cup. The double cup configuration, as illustrated in FIGS. 9, 10, and 11, may be provided with a vacuum gripper, thus with an external cup for vacuum and internal cup for inflating air. The vacuum seals against air escaping into the atmosphere. The double-cup can be used in two different applications as follows:

In the first application, an inflation structure, or air filling opening, is provided only on one side of the package. The vacuum holds the upper layer of the package. In the second application, inflation structures, or air filling ports, are provided in both the upper and the lower layers, as shown in FIG. 7, and the cups are the double cup shape of FIG. 10. Two double-cup devices are positioned on two opposite sides of the package. The vacuum pulls the two layers away from each other and creates a gap that enables air flow into the package.

In use, stacked un-inflated packages may be laid in piles of 100 or any other desirable quantity. Stacking allows automatic inflation more easily than if the packages are provided on a roll, but the embodiments apply to use of rolls as well.

In one example of use, stacks of different shapes of un-inflated packages can be placed side by side. The inflator can then inflate a predetermined sequence of any desired number of packages of different shapes.

The vacuum of the double-cup inflating nozzle may be used to lift the upper un-inflated package of the stack to an inflation position. Sealing the inflating channel by welding is typically done against support of some sort. However, in stacking, the welding can be done against the stack itself. Using non-return valves is an alternative way of sealing the air inside the inflated package and thus eliminates the welding altogether.

An advantage of the double-cup on both sides of the package version is that it is easier to make the inflation opening by cutting through both layers than by cutting through just one layer. An alternative solution is to cut through both layers but then to add adhesive tape or a sticker to cover the opening on one side.

A method of cutting an opening through just one of the layers involves using the double cup inflation device on a package not having an opening, to pull apart the two layers, and then insert a needle or other cutting tool into one of the layers to form the opening.

In a further example of use, the packages are inflated on a sloped table. After inflation and release by the grip, the inflated package falls or slides off the table into an open container for further handling, see for example FIGS. 19, 20A, 20B, 20C, 21 and 22, which are discussed in greater detail hereinbelow.

In another example of use, the package may be designed to fold automatically upon inflation. Thus the product to be wrapped is placed on the un-inflated package which is then inflated. The inflation causes the package to fold and wrap itself around the product. The wrapping can be done either on a flat surface or in a shipping box.

Figures 16A, 16B:
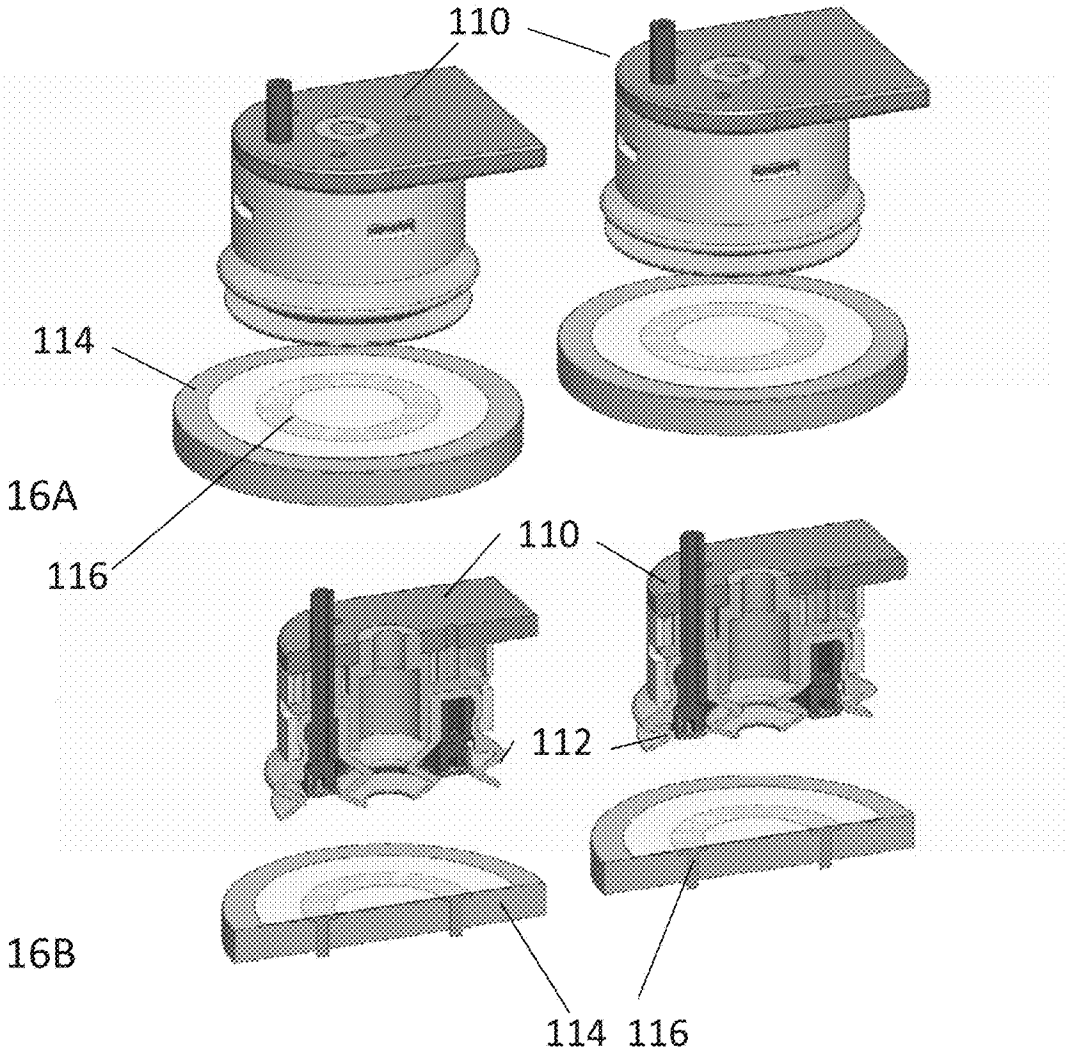
FIGS. 16A-16B show the device of FIG. 10 together with a plate for carrying out sealing of the package after inflation.

Reference is now made to FIG. 16A which shows in greater detail an arrangement for providing a ring seal on the package after inflation. Inflator part 110, shown in cross section in FIG. 16B retains the package wall after inflation using the outer structure—vacuum gripper—112. Underneath the inflator part 110 is plate 114 with a ring 116 which may be heated.

Figures 17A, 17B, 17C:
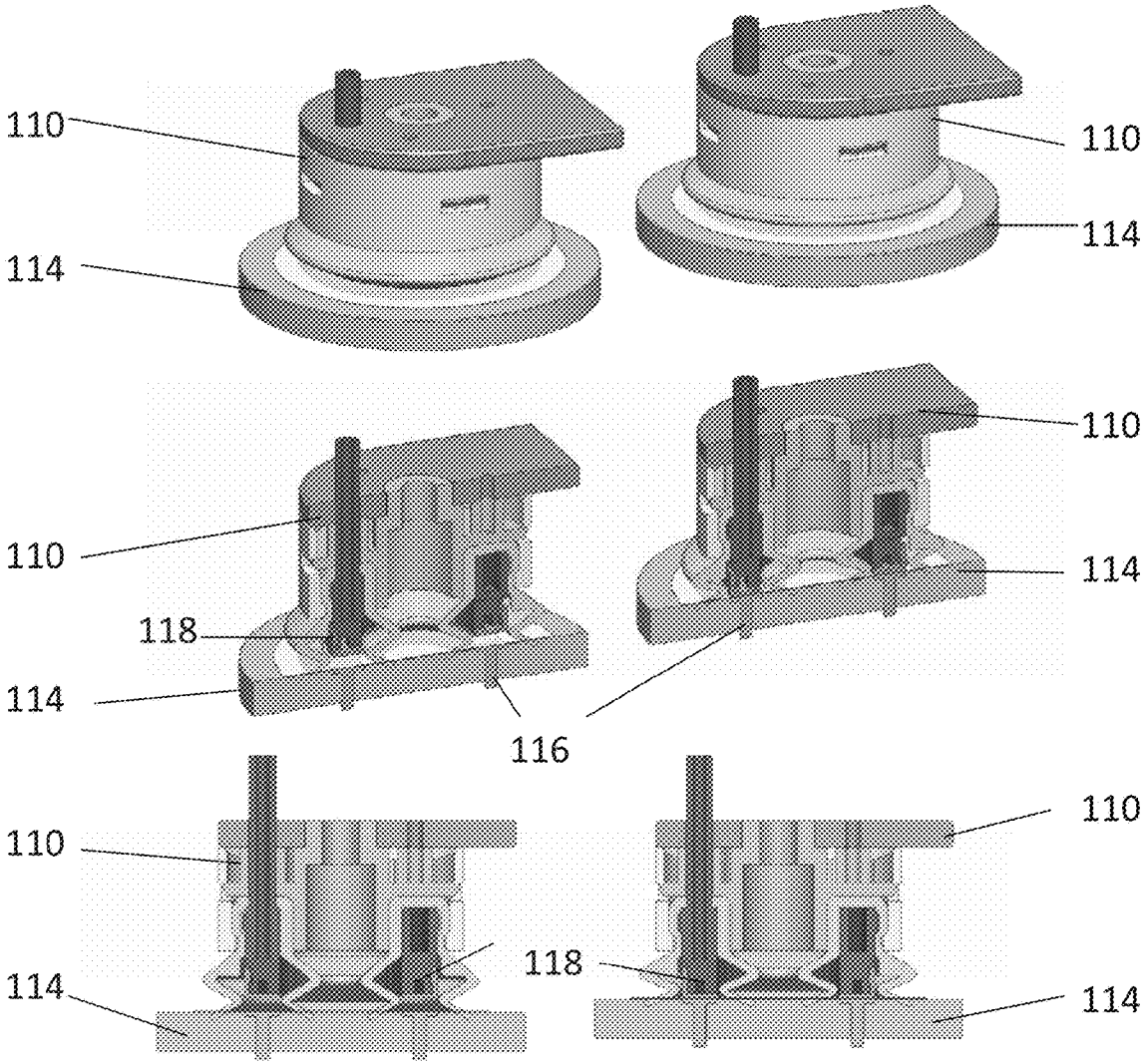
FIGS. 17A-17C show the device of FIGS. 16A and 16B with the inflation device and the plate pressing against each other for sealing.

Referring now to FIGS. 17A, 17B and 17C, the inflator part 110 moves towards the plate 114 and the part of the package between the ring 116 and the stopper 118 is both pressed and heated to form the seal.

FIG. 17B shows the cross section in perspective. FIG. 17C is a direct view of the cross section.

Reference is now made to FIG. 18 which is again the cross-sectional view of FIG. 17B with the inflation device pressing against the plate. However, in FIG. 18 the package is shown as two layers, an upper layer 120 with inflation opening 122, and a lower layer 114 without an opening.

Figure 18:
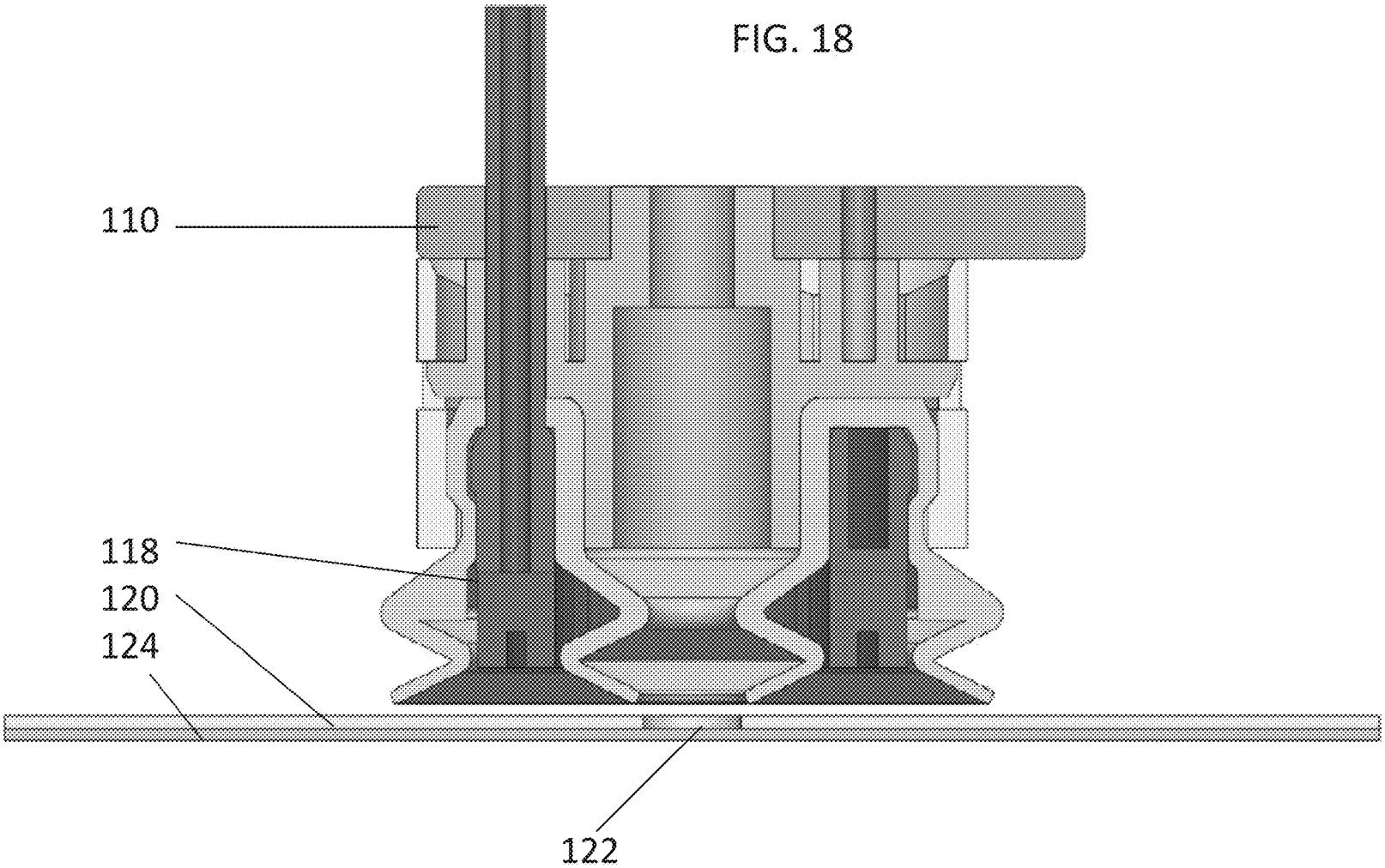
FIG. 18 is a schematic cross section showing the device of FIGS. 17A-C with a package positioned for sealing, between the inflation structure and the plate.
Figure 19:
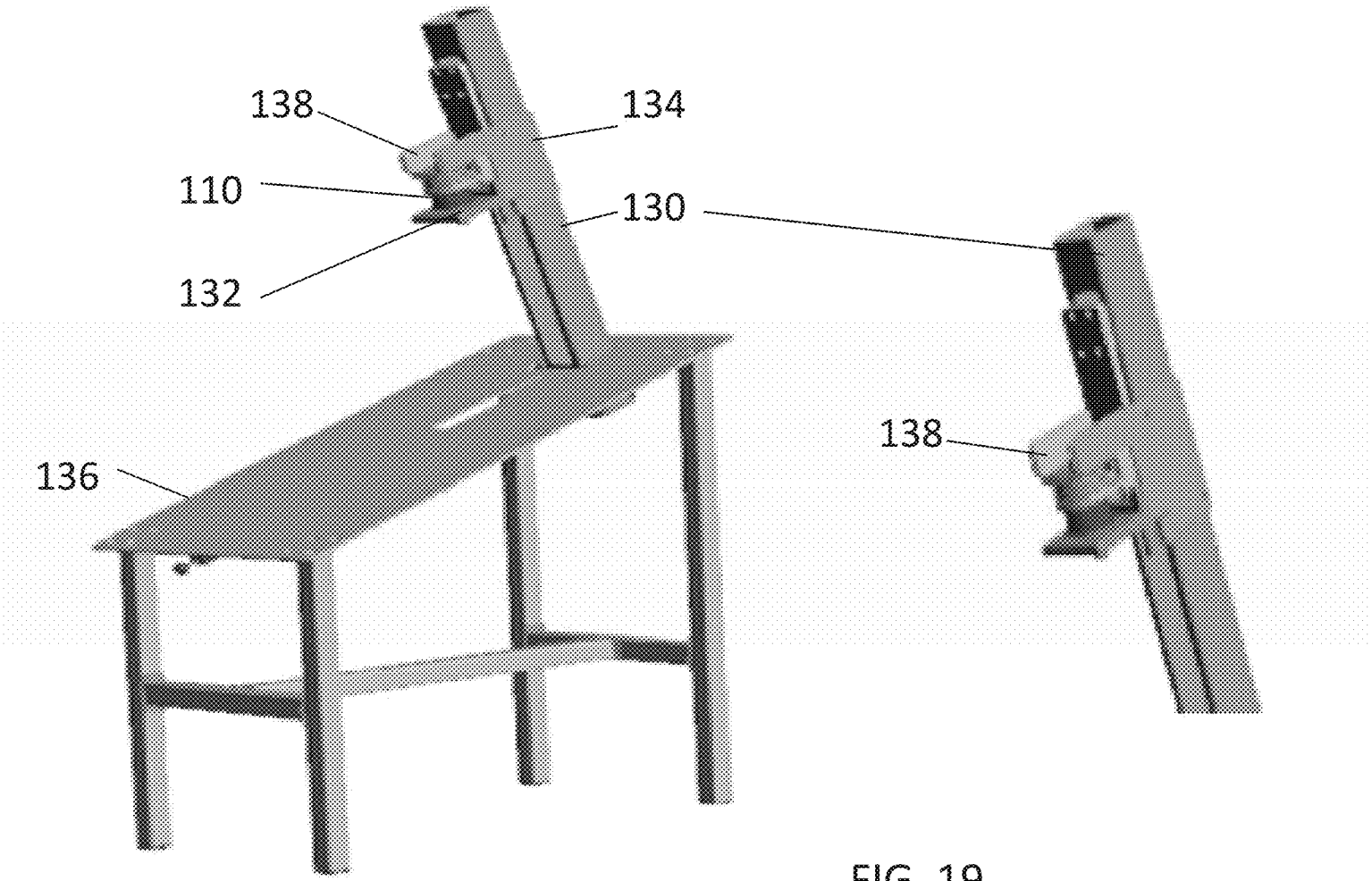
FIGS. 19 and 20A-20C show an inflation device according to an embodiment of the present invention mounted on an arm and taking up a raised and a lowered position.
Figure 20C:
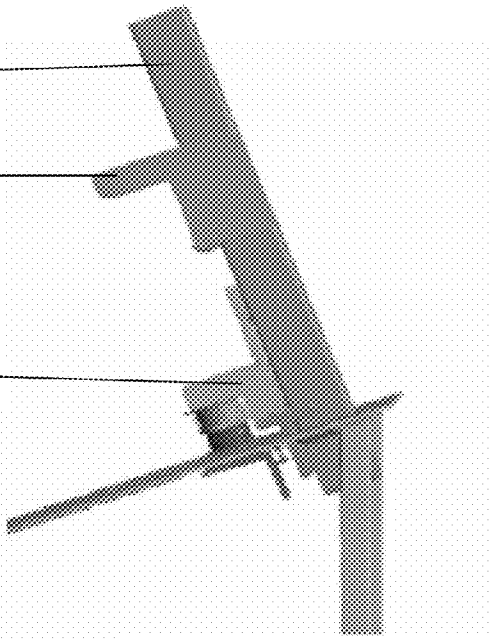
Figure 20B:
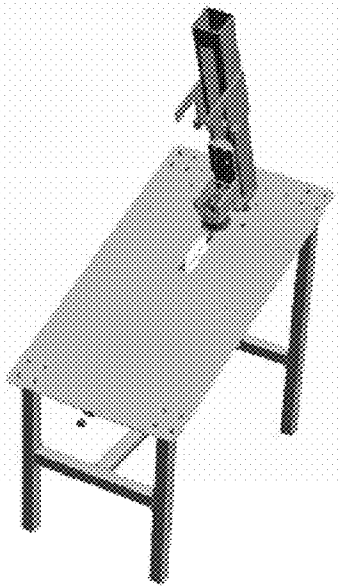
Figure 20A:
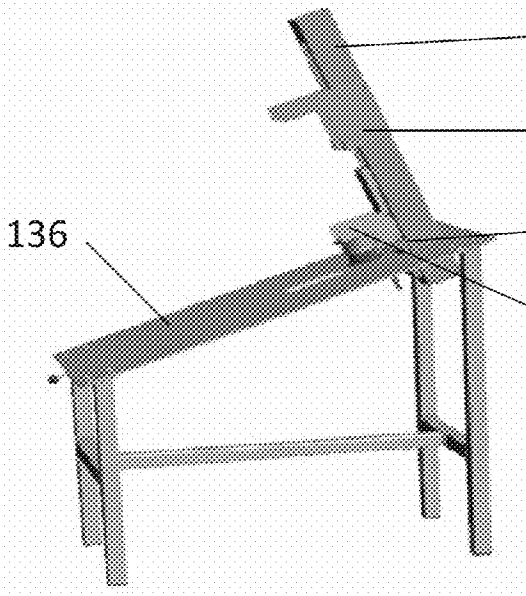

Reference is now made to FIG. 19 which shows the inflating device 110 of FIG. 18 attached to an arm 130 and a support plate 132. The arm 130 comprises a steel profile with an air piston inside to raise and lower the inflating device. The inflating device is able to slide between a raised position defined by bracket 134 and a lowered position defined by table 136. The support plate 132 may swivel, for example to attain a rotated position at the top of the device travel. A carriage 138 holds support plate 132 and the inflator device. FIGS. 20A, 20B and 20C show different perspectives of the inflator device in the lowered position. The table 136 is angled so that the package can be allowed to fall or slide onto a heap or into a basket once inflated.

It is noted that with the embodiment of FIG. 19, only a single piston is required to define the travel of the inflation structure. With the horizontal arm of the earlier figures three pistons may be required.

Reference is now made to FIGS. 21 and 22, which show an alternative embodiment 140 of the inflation device of FIG. 19 in which location pins 142 are used to align stacks of packaging. The stacks of packaging are placed on the pins and thus when a package is retrieved from the stack, the position of the inflation opening relative to the pins is known. The relative position of the inflation opening relative to the stack may vary between different stacks and may be programmed before or during loading of the stacks. Packages are then grabbed from the stacks and inflated as before.

In FIG. 22, when carriage 138 moves up, rollers 146, which are located on both sides of the steel profile arm 130 (FIGS. 20A, 20B), cause plate 144 to swivel and eventually reach a position perpendicular to arm 130. FIG. 21 shows plate 144 in its final position.

As shown in the previous figures, the inflator is mounted on an arm, such as a robot arm.

An alternative variation is handheld, and also carries out inflation and heat sealing. In one embodiment the handheld version may be configured with two arms, an upper arm holding the inflator device and a lower arm with a plate against which the heat sealing may be carried out. In order to inflate, the package is held between the two arms which are brought together on either side as with a stapler. Alternatively, the second arm could be dispensed with, and inflation and heat sealing carried out against the floor.

The hand-held version is particularly considered for use with air bubble sheets, such as those used for roof coverings or for covering swimming pools. Such sheets are currently shipped inflated.

The sheets may have multiple inflation ports, each one for inflating a part of the sheet.

Figure 23:
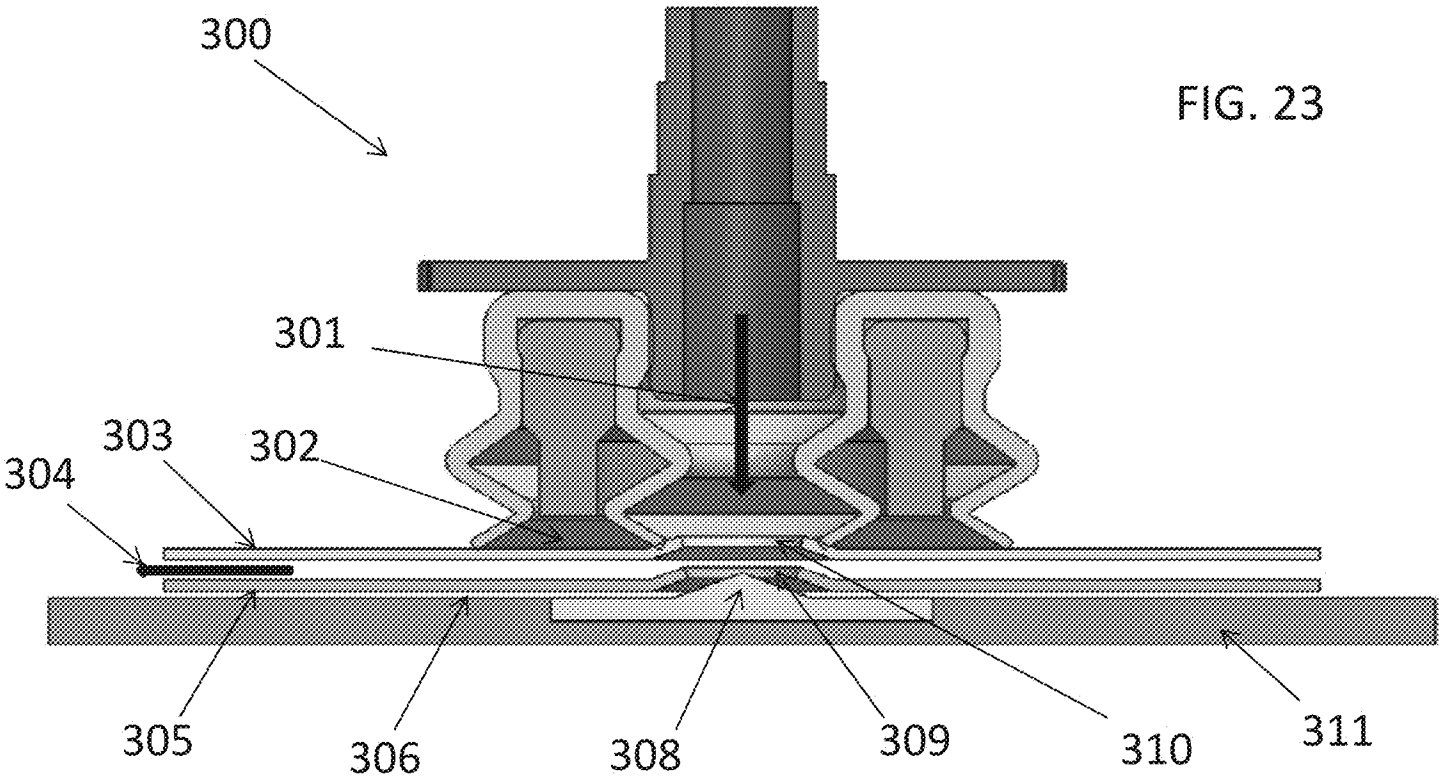
FIG. 23 shows a further alternative embodiment of the inflation device of the present invention in which Bernoulli's law is used to obviate the need for a sticker on the opening of the reverse side of the package to be inflated.

Reference is now made to FIG. 23, which is a simplified drawing illustrating a variation of the inflator which avoids the need for a sticker to be placed on the package opening opposite the inflation aperture. As discussed in the preceding embodiments, an inflation aperture is needed to inflate the package, and such an inflation aperture is needed in only one layer. However, it is impractical to punch a hole in just one layer because the layers are thin. The thickness runs between 20 to 900 microns, and therefore a hole is punched through both layers and a sticker is applied to one layer to seal the unwanted second hole so that the inflation air is directed towards the inside of the package rather than out through the second hole.

The following describes a device and method that allow inflation of a package with a hole punched through both layers, and without the need to apply a sticker to any of the holes. For simplicity, the layer with the inflation aperture used for inflation is referred to as the upper layer, and the layer with the unwanted aperture is referred to as the lower layer.

In general, once the bag is opened, the pressure of the inflation fluid tends to further open and inflate the package while at the same time drawing the lower layer towards the flat surface on which the bag has been placed.

FIG. 23 shows an inflation device 300 inflating a package with an upper layer 303 and a lower layer 305. Upper layer 303 has an inflation aperture 310 and lower layer 305 has an inflation aperture 309. Pressurized air indicated by arrow 301 flows through inflation device 300 toward the two apertures. Compartment 302 has vacuum therein and the vacuum causes upper layer 303 to be attached to the lips of compartment 302 and to separate upper layer 303 from lower layer 305. Pressurized air following the line of arrow 304 thus flows into the package. Pressurized air is also free to flow beneath the package lower layer 305 through aperture 309 into gap 306. Such a gap 306 may exist between lower layer 305 and base 311. Since the gap 306 is open to the outside air, the pressurized air entering is free to flow straight out at relatively high velocity compared to the stationary or near stationary air elsewhere. The relatively high velocity of the air flow in gap 306 causes the pressure in gap 306 to be lower than that in the surrounding atmosphere by Bernoulli's law. As a result, lower layer 305 adheres to base 311 and this prevents escape of further pressurized air into the atmosphere.

Figure 24:
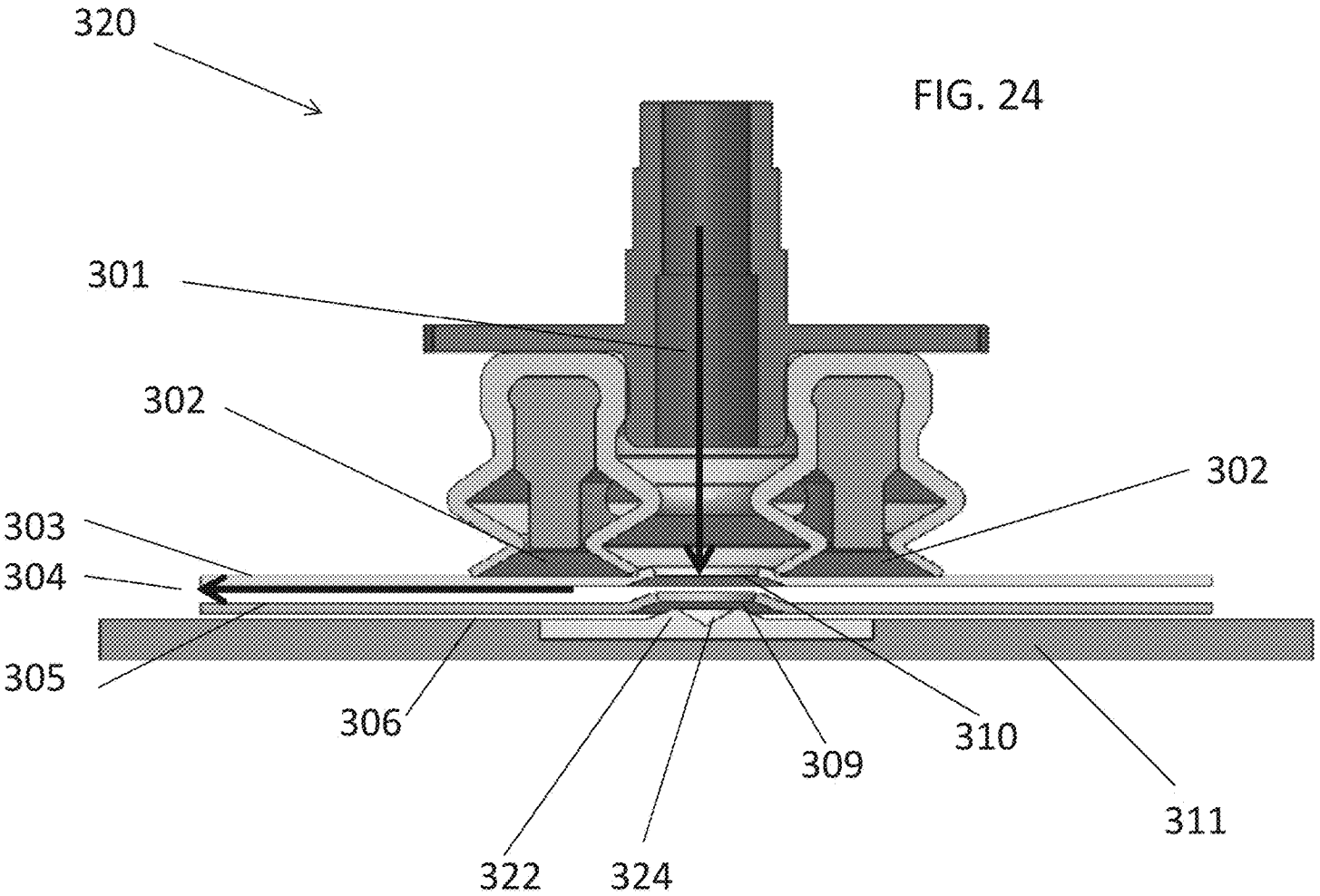
FIG. 24 illustrates a variation of the embodiment of FIG. 23 in which a recessed cone shape is used to redirect air to the interior of the package.

Cone 308 centers apertures 309 and 310 in the middle of the pressurized air flow and also serves to direct the flow of pressurized air following the direction of arrow 301 to fan out into the package. The lifting of upper layer 303 by the vacuum in compartment 302 and the adherence of lower layer 305 to base 311 open up a gap between the two layers that enable the inflation of the package. The gap 306 closes, and this is presumed to be an effect of Bernoulli's law, thus ensuring that very little pressurized air escapes to the atmosphere. Reference is now made to FIG. 24 which illustrates a variation 320 of the embodiment 300 of FIG. 23. Variation 320 is the same as FIG. 23, and the same reference numerals are used again for identical parts, except that in place of cone 308, an alternative cone 322 comprises a hollowed out center 324. The hollowed out center 324 receives the pressurized air flowing in the direction of arrow 301 and redirects the air upwards and outwards into the package in the direction of arrow 304. Gap 306 is closed. As mentioned above the closing of the gap is presumed to be due to Bernoulli's law but may also be due to an edge effect caused by the geometry of the lower aperture 309 and the shape of the cone.

Figure 25:
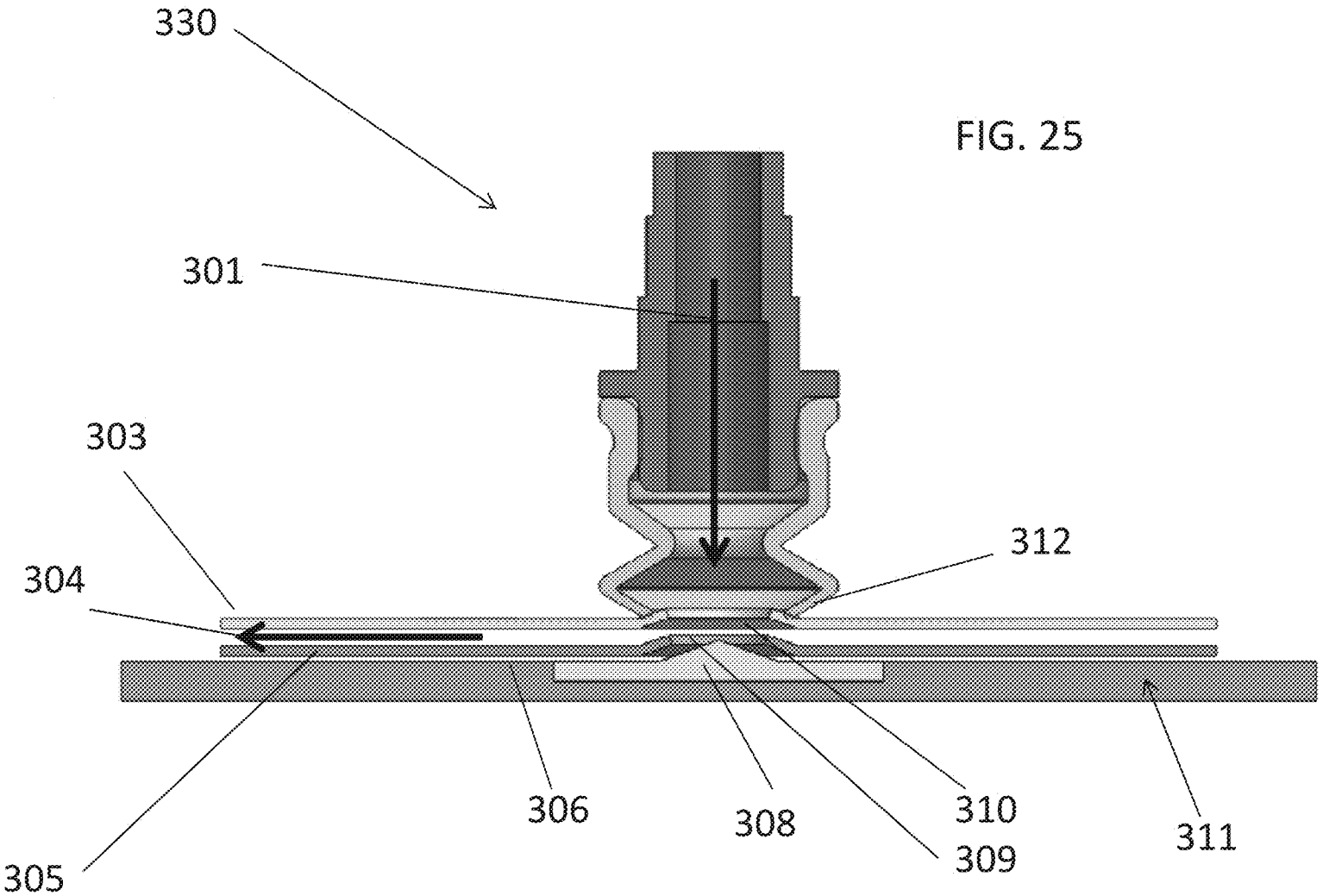
FIG. 25 is a simplified drawing showing a variation of the embodiment of FIG. 23 in which the inflation fluid is used to open the package for inflation instead of a suction ring.

Reference is now made to FIG. 25, which is a simplified drawing showing a variation 330 of the embodiment of FIG. 23 which lacks the suction ring 302. Without the suction ring the package is held sufficiently well due to being pushed by pressurized air 301 against base 311 and due to being fitted over cone 308. The package is initially flat and the suction ring is not present to open the package as in the embodiments of FIGS. 23 and 24. However application of pressurized air in fact opens the package. The pressurized air initially passes at velocity both over and under the package and suction on either side of the package pulls apart the package walls according to Bernoulli's law, thus opening the package for inflation. Inflation nozzle 314 may be made of soft flexible material such as rubber or silicone with lips pointed inwardly and touching upper layer 303. Pressurized air 301 pushes said inwardly pointed lips causing them to adhere to upper layer 303 thus preventing escape of pressurized air into the surrounding atmosphere.

Inflation of the package occurs without the cone at all, or with a complete cone or with a recessed cone.

In FIGS. 23-25, following inflation of the package the inflation port is sealed as with the preceding embodiments.

Returning to the embodiments as a whole, it is possible to save shipping space and storing space by sending the sheets un-inflated and performing inflation on site. The handgun that was previously mentioned may carry out both the inflation and the heat sealing.

It is expected that during the life of a patent maturing from this application many relevant packages, package precursors, robot arms and inflation mechanisms will be developed and the scope of the corresponding terms herein are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable subcombination or as suitable in any other described embodiment of the invention, and the above description is to be construed as if these separate embodiments were explicitly written. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An inflation device for pressurized inflation of an un-inflated package, the package comprising two layers, said layers being generally flat prior to inflation, and an inflation opening of a size up to a predetermined maximum size in said package, the inflation device comprising:

an inflation tool, for contacting the package at the inflation opening to inflate the package through the inflation opening using inflation fluid from a pressure source, the inflation tool having an enclosing surface to enclose said inflation opening, said enclosing being external to said package, said enclosing surface covering an area which is larger by a finite amount than said predetermined maximum size; and an outer wall, the outer wall defining a region surrounding said inflation tool and delineated by said inflation tool and said outer wall, said region being connected to a vacuum source, wherein said inflation tool comprises an inwardly turning lip and said outer wall comprises an outwardly turning lip, both of said inner wall and said outer wall forming 'w' shapes.

2. The inflation device of claim 1, comprising a co-operating gripper, the gripper configured for gripping the package, wherein the gripper comprises a fingerlike mechanism or a plate or a vacuum gripper or one or more feed wheels.

3. The inflation device of claim 1, wherein said region connected to a vacuum source is configured to pull apart said layers of said package.

4. The inflation device of claim 1, further comprising a stopping element extending across said region connected to a vacuum source, said stopping element being in a retracted position with respect to a plane containing said layers, said stopping element being configured to define a spacing between said layers of said package and thereby to limit ballooning by said package under influence of said vacuum source and air pressure.

5. The inflation device of claim 4, wherein said stopping element is heatable to form a heat seal on said package.

6. The inflation device of claim 1, wherein said inflation tool is configured to apply a pressure above surrounding pressure to said packaging, said pressure being one member of the group consisting of: a predetermined value, a value in excess of 0.1 bar, a value between 0.1 and 0.9 bar, and a value at a controlled amount between 0.1 bar and 0.9 bar.

7. The inflation device of claim 1, wherein said inflation tool is configured to check a pressure applied to said package prior to sealing of said package.

8. The inflation device of claim 1, wherein said enclosing inflation tool comprises one member of the group consisting of a flat plate enclosing said opening and an inwardly extending shape enclosing said opening.

9. The inflation device according to claim 1, further comprising a second inflation tool and a second surrounding vacuum region, configured to contact said package from an opposite side.

10. The inflation device of claim 9, said second surrounding vacuum region configured to cooperate with said first surrounding vacuum region to pull opposite layers of said package respectively apart.

11. The inflation device of claim 1, wherein said inflation tool is configured to inflate a package having a second opening opposite said inflation opening, the device comprising a cone for location of the second opening thereon.

12. The inflation device of claim 11, wherein said cone comprises a recess facing a source of said inflation fluid, said recess being configured to direct said inflation fluid outwardly into the interior of the package.

13. The inflation device of claim 2, with a plurality of un-inflated packages in stacks and a feeder mechanism configured to feed packages from each of said stacks upon request, to said inflation device for inflation.

14. The inflation device of claim 2, wherein said gripper is configured to obtain said package from a stack aligned using stack alignment pins.

15. The inflation device of claim 1, wherein said inflation tool is one member of the group consisting of a tool that is mounted on an arm and a handheld tool.

* * * * *